US005992512A

United States Patent [19]

Tsuri et al.

[11] Patent Number: 5,992,512

[45] **Date of Patent: *Nov. 30, 1999**

[54] HEAT EXCHANGER TUBE AND METHOD FOR MANUFACTURING THE SAME

[75] Inventors: Koutaro Tsuri, Hirakata; Hideaki Kameoka, Nishinomiya; Gou Isobe, Takatsuki; Takeshi Nishizawa, Nishinomiya; Masanori Ozaki, Ashiya, all of Japan

[73] Assignee: The Furukawa Electric Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/819,208

[22] Filed: Mar. 17, 1997

[30] Foreign Application Priority Data

| | | | |
|---|---|---|---|
| Mar. 21, 1996 | [JP] | Japan | 8-064668 |
| Mar. 28, 1996 | [JP] | Japan | 8-073998 |
| Jul. 11, 1996 | [JP] | Japan | 8-181070 |

[51] Int. Cl.[6] ..... F28F 13/18

[52] U.S. Cl. ..... 165/133; 165/184; 165/DIG. 515

[58] Field of Search ..... 165/133, 179, 165/184

[56] References Cited

U.S. PATENT DOCUMENTS

| | | | |
|---|---|---|---|
| 3,025,685 | 3/1962 | Whitlow | 165/133 X |
| 3,481,394 | 12/1969 | Withers, Jr. | 165/179 |
| 3,906,605 | 9/1975 | McLain | 165/133 X |
| 4,044,797 | 8/1977 | Fujie et al. | 165/133 X |
| 4,330,036 | 5/1982 | Satoh et al. | 165/179 |

FOREIGN PATENT DOCUMENTS

| | | | |
|---|---|---|---|
| 2043459 | 3/1972 | Germany | 165/133 |
| 57-100161 | 8/1955 | Japan . | |
| 58-51671 | 4/1958 | Japan . | |
| 57-26394 | 2/1982 | Japan | 165/133 |
| 59-38595 | 3/1984 | Japan | 165/133 |
| 64-35368 | 3/1989 | Japan . | |
| 1-73663 | 5/1989 | Japan . | |

*Primary Examiner*—Allen Flanigan

*Attorney, Agent, or Firm*—Frishauf, Holtz, Goodman, Langer & Chick, P.C.

[57] ABSTRACT

A heat exchanger tube for effecting a heat exchange between a fluid inside the heat exchanger tube and another fluid flowing outside the heat exchanger tube, which is provided with a first kind of spiral grooves and a second kind of spiral grooves, each being formed on an outer surface of the heat exchanger tube. The twisting direction of the first kind of spiral grooves in relative to the axis of the heat exchanger tube is the same as that of the second kind of spiral grooves but differs in helix angle from each other with helix angles of the first kind of spiral grooves and the second kind of spiral grooves falling within the range of 3° to 80° in relative to the axis of the heat exchanger tube.

3 Claims, 14 Drawing Sheets

FIG. 28A
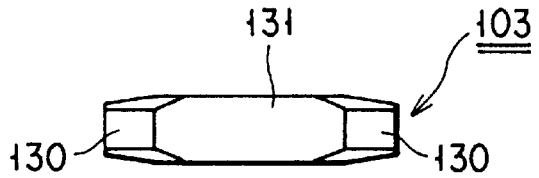
FIG. 28B
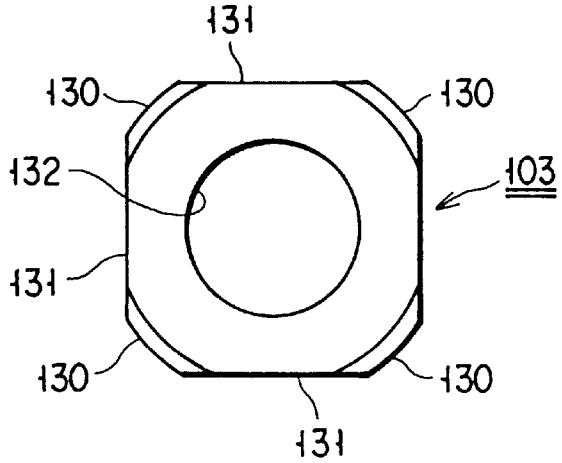
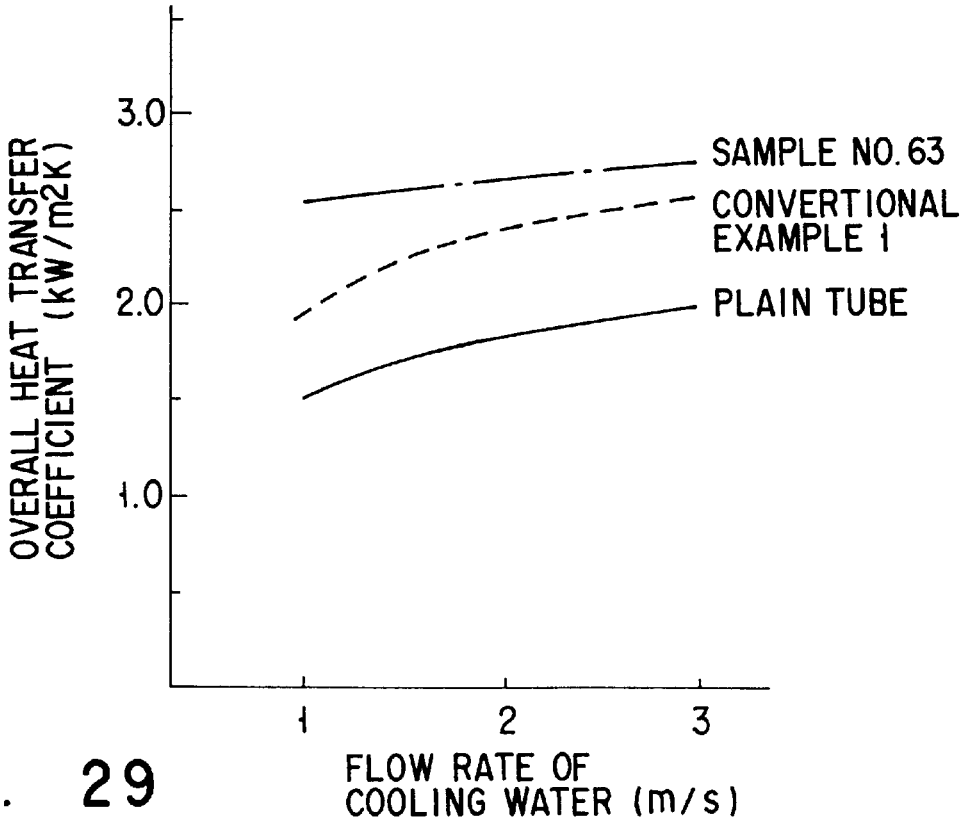
FIG. 29

HEAT EXCHANGER TUBE AND METHOD FOR MANUFACTURING THE SAME

BACKGROUND OF THE INVENTION

This invention relates to a heat exchanger tube which can be employed in an absorber, regenerator or evaporator of an absorption refrigerator for producing cold water or of an absorption heat pump for air-conditioner. This invention also relates to a method of manufacturing such a heat exchanger.

The absorber of an absorption refrigerator or of an absorption heat pump for air-conditioner is generally composed of many a number of heat exchanger tubes which are horizontally arranged in rows and in multistage. This group of heat exchanger tubes are adapted to be sprayed from the top thereof with an absorption liquid such as an aqueous solution of lithium bromide.

During the time this sprayed absorption liquid flows down along the outer surfaces of the heat exchanger tubes, the vapor of refrigerant generated from an evaporator is absorbed by the absorption liquid and at the same time the heat generated in the absorption reaction is transferred through heat exchange to a cooling water flowing in the heat exchanger tubes. Therefore, it is imperative for improving the performance of the absorber to promote the phenomenon of mass transfer in this process of absorbing the vapor of refrigerant.

At the moment when an aqueous solution of lithium bromide absorbs the vapor of refrigerant, a mass transfer as shown in FIG. 1 takes place at an interface between the absorption liquid A and the refrigerant vapor B. Namely, at the surface layer Aa of the absorption liquid A, i.e. at the interface layer between the absorption liquid A and the refrigerant vapor B, the concentration of the absorption liquid A becomes thinner as compared with that of inner layer Ab of the absorption liquid A which is close to the surface of the heat exchanger tube C. Accordingly, if the absorption of the refrigerant vapor B is to be promoted, the turbulence of the absorption liquid A on the heat exchanger tube C is required.

Because of this, in case of the absorption refrigerator or the absorption heat pump for air-conditioner which is actually used now by making use of an aqueous solution of lithium bromide, a surfactant such as n-octyl alcohol or 2-ethyl-1-hexanol is added at a concentration of several tens to several hundreds ppm to an aqueous solution of lithium bromide so as to cause a turbulence action (which is called Marangoni convection) in the absorption liquid in the aforementioned process of refrigerant vapor absorption. Namely, a method of improving the refrigerant vapor absorption capacity of the absorption liquid by making the most of this Marangoni convection is generally adopted now.

Accordingly, it is now desired, in view of improving the performance of the heat exchanger tube of an absorber, to effectively promote the turbulence by way of Marangoni convection of an absorption liquid layer on the outer surface of the heat exchanger tube, which would be generated as mentioned above as the absorption liquid absorbs the refrigerant vapor.

A heat exchanger tube which is designed to promote the turbulent action in the absorption liquid has been proposed by Japanese Utility Model Unexamined Publication S/57-100161. The heat exchanger tube disclosed in this Japanese Utility Model Unexamined Publication S/57-100161 is worked such that fine spiral grooves are formed on the outer surface thereof. The purpose of providing the spiral grooves is to allow an absorption liquid to flow along the spiral grooves so as to spread the flow of the absorption liquid on the surface of the heat exchanger tube and at the same time to promote the turbulence in the absorption liquid layer by the irregular surface which has been effected by these spiral grooves.

Another example of heat exchanger tube which is also designed to promote the turbulent action in the absorption liquid has been proposed by Japanese Utility Model Unexamined Publication S/64-35368. The heat exchanger tube disclosed in this Japanese Utility Model Unexamined Publication S/64-35368 is provided on the outer surface thereof with fine spiral grooves, i.e. a first kind of spiral grooves and a second kind of spiral grooves twisted in a direction opposite to that of the first kind of spiral grooves, thus forming protrusions which are formed by the intercrossing of these two sets of spiral grooves. The purpose of providing two sets of spiral grooves is to allow an absorption liquid to impinge against the protrusions formed by the intercrossing of these grooves so as to promote the turbulence in the absorption liquid.

In the case of the heat exchanger tube described in this Japanese Utility Model Unexamined Publication S/57-100161, it is certainly possible as shown in FIG. 2A to spread the flow of the absorption liquid layer on the surface of the heat exchanger tube C1 due to the presence of the spiral grooves V1. However, since the spiral grooves V1 is linear, the turbulence of the absorption liquid to be obtained would be insufficient.

On the other hand, in the case of the heat exchanger tube described in the Japanese Utility Model Unexamined Publication S/64-35368, the absorption liquid layer A2 is impinged upon a protrusion E1 thereby to generate a turbulence. However, since these two sets of spiral grooves V2 and V3 are twisted in an opposite direction from each other in relative to longitudinal direction of the tube and hence intercrossed with each other, the turbulence of absorption liquid layer A2 generated by the protrusion E1 is caused to collide with the turbulence of absorption liquid layer A3 generated by the protrusion E2 disposed next to the protrusion E1. As a result, it is impossible to maintain the turbulence of the absorption liquid layers A2 and A3 along the longitudinal direction of the tube, thereby making it difficult to effectively promote the turbulence of the absorption liquid. Therefore, it is difficult to maintain the turbulence of the absorption liquid layers A2 and A3 on the surface of the heat exchanger tube C2 for a long period of time.

On the other hand, in the case of an absorption refrigerator or an absorption type hot and cold water generator, a cold water is produced by taking the latent heat of vaporization of a refrigerant from a water to be cooled when the refrigerant is vaporized from an evaporator. The vaporized refrigerant from the evaporator is then absorbed by an absorption liquid in an absorber so as to be turned back to a liquid state while releasing the latent heat of vaporization and the heat of dilution.

Since the absorption of refrigerant becomes more difficult with a rise in temperature of an absorption liquid, the absorption liquid is required to be cooled by the surface of a heat exchanger tube, thereby inhibiting the absorption liquid from heated excessively by the latent heat of vaporization and the heat of dilution.

Generally, the ordinary absorber is constructed such that many a number of heat exchanger tubes are arranged horizontally or vertically and an absorption liquid is allowed to flow down along the surfaces of these heat exchanger tubes in which a cooling water is circulated. The heat exchanger tube is generally constructed of a plain tube unless there is any special requirement to employ a high performance heat exchanger tube for the purpose of enhancing the performance of the tube.

For improving the performance of heat exchanger tube in an absorber, the following countermeasures are required to be taken.

(1) To increase the heat exchange area;

(2) To minimize the non-uniformity in concentration between the upper layer and the lower layer of the absorption liquid layer, which is caused from the absorption of vapor by the surface of the running absorption liquid and the resultant thinning in concentration of the absorption liquid; and (3) To promote the interfacial turbulence of the absorption liquid flowing down along the surface of the heat exchanger tube.

One example of such a high performance heat exchanger tube is proposed in Japanese Utility Model Unexamined Publication S/57-100161, wherein many a number of fine spiral grooves are formed on the outer surface of the heat exchanger tube. Another example of such a high performance heat exchanger tube is proposed in Japanese Utility Model Application S/58-51671, wherein many a number of fine spiral grooves of the same depth intercrossing with each other are formed on the outer surface of the heat exchanger tube. Still another example of such a high performance heat exchanger tube is proposed in Japanese Utility Model Unexamined Publication H/1-73663, wherein many a number of fine spiral grooves which are intercrossed with each other are formed on the outer surfaces of only the end portions of the heat exchanger tube.

It is admitted that the performance of a heat exchanger tube can be improved by forming many a number of fine spiral grooves on the outer surface of the heat exchanger tube; by forming many a number of fine spiral grooves on the outer surface of the heat exchanger tube in such a manner that these spiral grooves intercross with each other; or by forming many a number of intercrossed fine spiral grooves on the outer surfaces of only the end portions of the heat exchanger tube.

However, the method of forming many a number of fine spiral grooves in the same depth and in the same direction on the outer surface of the heat exchanger tube, as well as the method of forming many a number of intercrossed fine spiral grooves on the outer surfaces of only the end portions of the heat exchanger tube, as disclosed in Japanese Utility Model Unexamined Publications S/57-100161 and H/1-73663, are accompanied with a problem that the flow of the absorption liquid on the surface of the heat exchanger tube becomes unidirectional so that it is difficult to achieve a sufficient interfacial turbulence of the absorption liquid, which is one of the aforementioned requirements to improve the performance of heat exchanger tube.

On the other hand, the method of forming many a number of fine spiral grooves of the same depth on the outer surface of the heat exchanger tube in such a manner that these grooves intercross with each other as suggested in Japanese Utility Model Application S/58-51671 is also accompanied with a problem that since the flow of the absorption liquid simply runs down along the bottom of the spiral groove, the spread of the flow of the absorption liquid in the longitudinal direction of the heat exchanger tube is not so promoted, and it is difficult to minimize the non-uniformity in concentration between the upper layer and the lower layer of the absorption liquid layer.

Because of these reasons, the improvement in heat exchange property of the absorber is still insufficient even if the aforementioned heat exchanger tubes are substituted for the plain tube.

BRIEF SUMMARY OF THE INVENTION

Accordingly, an object of the present invention is to provide a heat exchanger tube which is capable of sufficiently spreading an absorption liquid on the outer surface of the heat exchanger tube, and at the same time capable of sufficiently promoting the turbulence of the absorption liquid in the dropping direction of the absorption liquid (a direction perpendicular to the longitudinal direction of the heat exchanger tube) as well as in the direction parallel to the longitudinal direction of the heat exchanger tube.

Another object of this invention is to provide a method of manufacturing a heat exchanger tube which is capable of sufficiently spreading an absorption liquid on the outer surface of the heat exchanger tube, and at the same time capable of sufficiently promoting the turbulence of the absorption liquid in the dropping direction of the absorption liquid (a direction perpendicular to the longitudinal direction of the heat exchanger tube) as well as in the direction parallel to the longitudinal direction of the heat exchanger tube.

A further object of this invention is to provide a heat exchanger tube which is capable of minimizing the non-uniformity in concentration between the upper layer and the lower layer of the absorption liquid layer on the surface of the heat exchanger tube, and capable of promoting the interfacial turbulence of the absorption liquid, thereby making it possible to greatly improve the heat exchange property thereof.

Namely, according to the present invention, there is provided a heat exchanger tube for effecting a heat exchange between a fluid inside the heat exchanger tube and another fluid flowing outside the heat exchanger tube, which is provided with a first kind of spiral grooves and a second kind of spiral grooves, each being formed on an outer surface of the heat exchanger tube, wherein a twisting direction of the first kind of spiral grooves in relative to the axis of the heat exchanger tube is the same as that of the second kind of spiral grooves but differs in helix angle from each other with helix angles of the first kind of spiral grooves and the second kind of spiral grooves falling within the range of 3° to 80° in relative to the axis of the heat exchanger tube.

According to the present invention, there is further provided a heat exchanger tube for effecting a heat exchange between a fluid inside the heat exchanger tube and another fluid flowing outside the heat exchanger tube, which is provided with a first kind of spiral grooves and a second kind of spiral grooves, each being formed on an outer surface of the heat exchanger tube, wherein a twisting direction of the first kind of spiral grooves in relative to the axis of the heat exchanger tube is opposite to that of the second kind of spiral grooves, helix angles of the first kind of spiral grooves and the second kind of spiral grooves fall within the range of 3° to 80° in relative to the axis of the heat exchanger tube, and the first kind of spiral grooves differs in either depth or pitch in circumferential from the second kind of spiral grooves.

Further, according to the present invention, there is also provided a method of manufacturing a heat exchanger tube which comprises the steps of; disposing plural kinds of rolling members each having spiral grooves on an outer smooth surface of a raw tube; and rotating the plural kinds of rolling members while pressing the plural kinds of rolling members onto the outer smooth surface of raw tube, thereby forming plural spiral grooves comprising different kinds of spiral grooves, one kind of which being the same in twisting angle as that of the other kind but differing in helix angle from that of the other kind.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 28A and 28B illustrate integrally a side view and a plan view of a working roll to be employed in an apparatus for manufacturing a heat exchanger tube according to another embodiment of the present invention;

FIG. 29 is a graph illustrating the performance of a heat exchanger tube according to another embodiment of the present invention;

DETAILED DESCRIPTION OF THE INVENTION

Figure 1:
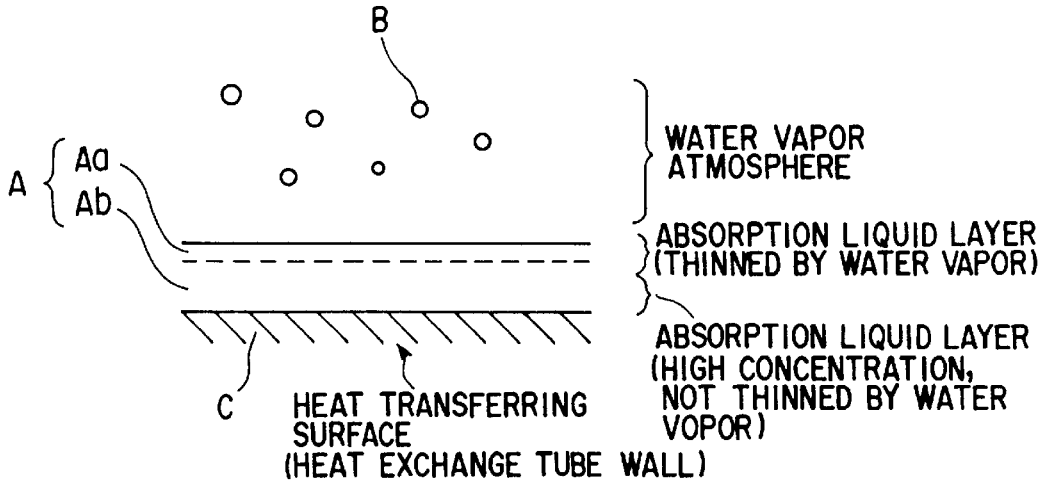
FIG. 1 is a schematic illustration showing a state of the interface between an absorption liquid layer and a refrigerant vapor in the process of absorbing the refrigerant vapor by an aqueous solution of lithium bromide on the outer surface of a heat exchanger tube.
Figure 2A:
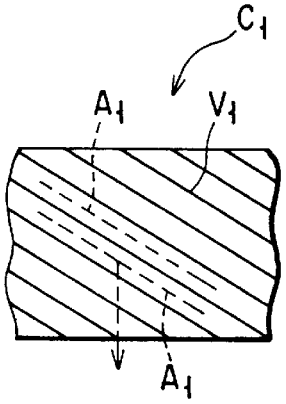
FIGS. 2A to 2C represent respectively a schematic illustration showing a flow of an absorption liquid layer in relative to the spiral grooves of the conventional heat exchanger tube or of the present invention.
Figure 2B:
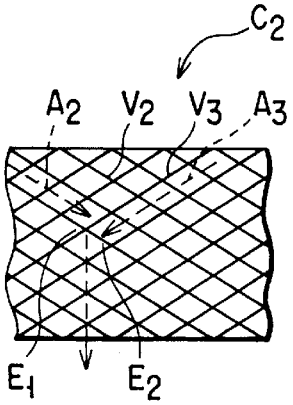
Figure 2C:
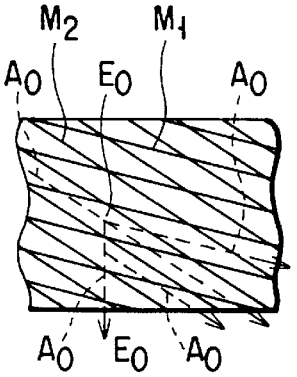

A heat exchanger tube according a first aspect of this invention for effecting a heat exchange between a fluid inside the heat exchanger tube and another fluid flowing outside the heat exchanger is featured in that it is provided on the outer surface thereof with at least two kinds of spiral grooves, each kind being the same in twisting direction in relative to the axis of the heat exchanger tube but differing in helix angle from each other with helix angles of all of these spiral grooves falling within the range of 3° to 80° in relative to the axis of the heat exchanger tube.

In the case of the heat exchanger tube according to the first aspect of this invention, since the heat exchanger tube is provided on the outer surface thereof with at least two kinds of spiral grooves which are the same in twisting direction in relative to the axis of the heat exchanger tube but differ in helix angle from each other, it is possible to promote the turbulence of an absorption liquid layer when this heat exchanger tube is employed in an absorber where heat exchanger tubes are horizontally arranged. To be more specific, because many a number of protrusions, each encircled by at least two kinds of spiral grooves, are formed on the outer surface of this heat exchanger tube, an absorption liquid layer is caused to be impinged upon these protrusions thereby to promote the turbulence in the absorption liquid layer.

Moreover, since these at least two kinds of spiral grooves are twisted in the same direction in relative to the axis of the heat exchanger tube, the absorption liquid thus disturbed by the protrusions are allowed to sufficiently spread over the outer surface of the heat exchanger tube while crossing over the intercrossed portions of the spiral grooves, and at the same time the turbulence of the absorption liquid can be sufficiently promoted also in the dropping direction of the absorption liquid (a direction perpendicular to the longitudinal direction of the heat exchanger tube).

The helix angle of these spiral grooves is confined to the range of 3° to 80° in relative to the axis of the heat exchanger tube, because this range is suited for bringing about the turbulence of the absorption liquid. Namely, if the helix angle is smaller than 3° in relative to the axis of the heat exchanger tube, the absorption liquid is caused to flow on both sides of the groove whereby causing a collision of flow between absorption liquid layers, thus preventing the absorption liquid layers from spreading stably in a predetermined direction and at the same time making it difficult to promote the turbulence of the absorption liquid layer in the longitudinal direction of the heat exchanger tube. On the other hand, if the helix angle exceeds over 80° in relative to the axis of the heat exchanger tube, the protrusions formed between the spiral grooves may become an obstacle to the movement of the absorption liquid layer in the longitudinal direction of the heat exchanger tube, thus making it difficult to promote the turbulence of the absorption liquid layer in the longitudinal direction of the heat exchanger tube.

If the helix angles of these at least two kinds of spiral grooves are too close to each other, the protrusion encircled by these spiral grooves cannot be sufficiently formed and hence any substantial effect by the protrusion to disturb the absorption liquid layer cannot be expected. Therefore, the difference in helix angle between these at least two kinds of spiral grooves should preferably be controlled to not less than 10°. For instance, when the heat exchanger tube is provided with three kinds of spiral grooves, the helix angle of these three kinds of spiral grooves may be varied by an angle of 15°, i.e. helix angle of 15°, 30° and 45° in relative to the axis of the heat exchanger tube. If the helix angle of these three kinds of spiral grooves is set in this manner, the protrusions encircled by these spiral grooves can be regularly arranged, and the effect of the protrusions to disturb the absorption liquid layer can be sufficiently manifested.

In the heat exchanger tube according to this first aspect of this invention, the depth of spiral grooves should preferably be in the range of 0.1 to 1.5 mm, and the pitch of spiral grooves in the circumferential should preferably be in the range of 0.25 to 10 mm. Because, if the depth and pitch of spiral grooves are less than the aforementioned lower limits, the effect of the protrusions to disturb the absorption liquid layer cannot be sufficiently attained, while if the depth and pitch of spiral grooves exceed over the aforementioned upper limits, it may become difficult for the absorption liquid to run over these protrusions and to spread around the outer surface of the heat exchanger tube.

Followings are preferable embodiments of the heat exchanger tube according to the first aspect of this invention.

(1) One of at least two kinds of spiral grooves differs in either depth or pitch in circumferential, or in both depth and pitch from other kind(s) of spiral grooves.

If the spiral grooves are formed in this manner, the size of the protrusions on the outer surface of the heat exchanger tube becomes random, thus producing a difference in thickness of the absorption liquid layer. As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

(2) One kind of spiral grooves which is the largest in groove depth among at least two kinds of spiral grooves has a groove depth ranging from 0.3 to 1.5 mm and a pitch in circumferential ranging from 0.8 to 5.0 mm, while the other kind(s) of spiral grooves has a groove depth ranging from 0.1 to 0.7 mm and a pitch in circumferential ranging from 0.25 to 2.0 mm.

If the spiral grooves are formed in this manner, an optimum difference in thickness of the absorption liquid layer is caused to be generated by the protrusions formed on the outer surface of the heat exchanger tube. As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

(3) The helix angle of one kind of spiral grooves which is the smallest in helix angle among all kinds of spiral grooves is confined to the range of 3° to 30° in relative to the axis of the heat exchanger tube.

If the spiral grooves are formed in this manner, the absorption liquid layer can be stably spread along the longitudinal direction of the heat exchanger tube.

(4) At least the groove depth of one kind of spiral grooves which is the smallest in helix angle among all kinds of spiral grooves is made larger than the groove depth of the other kind(s) of spiral grooves.

If the spiral grooves are formed in this manner, the absorption liquid layer can be easily spread along the longitudinal direction of the heat exchanger tube, since the groove depth of the spiral grooves which is the smallest in helix angle among all kinds of spiral grooves is made larger than the groove depth of the other group(s) of spiral grooves. As a result, the turbulence of the absorption liquid can be further promoted in the longitudinal direction of the heat exchanger tube and a more efficient heat exchange can be performed.

(5) Spiral rib is formed on the inner surface of the heat exchanger tube in conformity with the shape of the spiral grooves which are the largest in depth among all kinds of spiral grooves formed on the outer surface of the heat exchanger tube.

If the spiral rib is formed in this manner, a turbulence may be caused to generate in the flow, for example, of a cooling water flowing inside the heat exchanger tube, thereby improving the performance of the inside of heat exchanger tube. At the same time, any superfluous thickness of the heat exchanger tube can be reduced, thus making the thickness of the tube as uniform as possible in the circumferential thereof, and hence reducing the total weight of the tube and saving the manufacturing cost.

(6) A raw tube having a smooth outer surface is worked with plural kinds of rolling tools each having predetermined shape of spiral grooves, i.e. by arranging the rolling tools on the outer smooth surface of the raw tube, and rotating the rolling tools, while pressing these rolling tools onto the outer smooth surface of raw tube, thereby forming at least two kinds of spiral grooves differing in helix angle from each other in relative to the axis of the heat exchange tube.

When the spiral grooves are formed in this manner, two or more kinds of spiral grooves can be formed by a single step of rotating the rolling tools such as dies or rolls, each having predetermined shape of spiral grooves, while pressing these rolling tools onto the outer smooth surface of raw tube. Therefore, the time and trouble of exchanging the tools can be saved thereby improving the productivity.

(7) A raw tube having a smooth inner surface is worked by introducing a plug into the inside of the tube so as to form a corrugation on the inner surface of the tube in conformity with the shape of the spiral grooves which are the largest in depth among all kinds of spiral grooves formed on the outer surface of the tube.

When this method is adopted, since a raw tube having a smooth inner surface is worked by introducing a plug into the inside of the tube and corrugation is formed with this plug on the inner surface of the tube in conformity with the shape of the spiral grooves which are the largest in depth among all kinds of spiral grooves formed on the outer surface of the tube, a turbulence can be generated in the flow, for example, of a cooling water flowing inside the heat exchanger tube, thereby improving the performance of the inside of heat exchanger tube. Additionally, any superfluous thickness of the heat exchanger tube can be reduced, thus making the thickness of the tube as uniform as possible in the circumferential thereof, and hence reducing the total weight of the tube and saving the manufacturing cost.

A heat exchanger tube according a second aspect of this invention for effecting a heat exchange between a fluid inside the heat exchanger tube and another fluid flowing outside the heat exchanger is featured in that it is provided with at least two kinds of spiral grooves, each being formed on an outer surface of the heat exchanger tube, wherein a twisting direction of one kind of spiral grooves in relative to the axis of the heat exchanger tube is opposite to that of other kind(s) of spiral grooves, the helix angles of all kinds of spiral grooves fall within the range of 3° to 80° in relative to the axis of the heat exchanger tube, and at least one kind of spiral grooves among at least two kinds of spiral grooves differs in depth from other kind(s) of spiral grooves.

In the case of the heat exchanger tube according to the second aspect of this invention, since many a number of protrusions each encircled by at least two kinds of spiral grooves can be formed on the outer surface of the heat exchanger tube, it is possible, when this heat exchanger tube is employed in an absorber where heat exchanger tubes are horizontally arranged, to allow the absorption liquid to impinge upon these protrusions, thereby promoting the turbulence of an absorption liquid layer. Moreover, since these at least two kinds of spiral grooves are twisted in the opposite direction in relative to the axis of the heat exchanger tube, the absorption liquid thus disturbed by the protrusions are allowed to sufficiently spread over the outer surface of the heat exchanger tube while crossing over the intercrossed portions of the spiral grooves, and at the same time the turbulence of the absorption liquid can be sufficiently promoted also in the dropping direction of the absorption liquid (a direction perpendicular to the longitudinal direction of the heat exchanger tube).

Furthermore, since the helix angle of these spiral grooves is confined to the range of 3° to 80° in relative to the axis of the heat exchanger tube, the turbulence of the absorption liquid can be effectively promoted. Namely, if the helix angle is smaller than 3° in relative to the axis of the heat exchanger tube, the absorption liquid is caused to flow on both sides of the groove whereby causing a collision of flow between absorption liquid layers, thus preventing the absorption liquid layers from spreading stably in a predetermined direction and at the same time making it difficult to promote the turbulence of the absorption liquid layer in the longitudinal direction of the heat exchanger tube.

On the other hand, if the helix angle exceeds over 80° in relative to the axis of the heat exchanger tube, the protrusions formed between the spiral grooves may become an obstacle to the movement of the absorption liquid layer in the longitudinal direction of the heat exchanger tube, thus making it difficult to promote the turbulence of the absorption liquid layer in the longitudinal direction of the heat exchanger tube.

Since the absorption liquid flowing downward along these at least two kinds of spiral grooves twisted at an angle of 3° to 80° in relative to the axis of the heat exchanger tube is forced to run in opposite ways, i.e. an absorption liquid flow running along a deep groove and another absorption liquid flow running along a shallow groove whose direction is opposite to that of the deep groove, the absorption liquid layer of lower concentration running along a shallow groove and the absorption liquid layer of higher concentration running along a deep groove are caused to collide with each other. As a result, any non-uniformity in concentration between the upper layer of the absorption liquid and lower layer of the absorption liquid can be minimized, and at the same time the interfacial turbulence can be produced more frequently in the absorption liquid.

Followings are preferable embodiments of the heat exchanger tube according to the second aspect of this invention.

(1) At least one kind among at least two kinds of spiral grooves is directed opposite in twisting direction to other kind(s) of spiral grooves in relative to the axis of the heat exchanger tube, and at the same time the absolute values in helix angle, in relative to the axis of the heat exchanger tube, of at least two kinds of spiral grooves differ from each other.

If the spiral grooves are formed in this manner, the flow of the absorption liquid on the outer surface of the heat exchanger tube can be varied. For example, the absorption liquid layer running along spiral grooves of smaller helix angle is induced to flow along the longitudinal direction of the tube, while the absorption liquid layer running along spiral grooves of larger helix angle functions to control the flow of absorption liquid to be directed in a fixed circumferential. As a result, the heat exchanging performance by the heat exchanger tube can be further promoted by this synergistic effect.

(2) The groove depth of spiral grooves is confined to a range of from 0.1 to 1.5 mm and the pitch in circumferential thereof to range from 0.3 to 4 mm, while a difference in groove depth of among these at least two kinds of spiral grooves is set to 1.15 times or more as measured based on a shallower group of spiral grooves.

Because, if the depth and pitch of spiral grooves are less than the aforementioned lower limits, the effect of the protrusions to disturb the absorption liquid layer cannot be sufficiently attained, while if the depth and pitch of spiral grooves exceed over the aforementioned upper limits, it may become difficult for the absorption liquid to run over these protrusions and to spread around the outer surface of the heat exchanger tube. If a difference in groove depth of among these at least two kinds of spiral grooves is set to 1.15 times or more as measured based on a shallower group of spiral grooves, the protrusion to be formed on the outer surface of the heat exchanger tube can be optimized in relative to the thickness of the absorption liquid.

As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

(3) The helix angle of these at least two kinds of spiral grooves is confined to a range of from 15° to 45° and the groove depth thereof is confined to a range of from 0.1 to 1.5 mm.

When the helix angle and the groove depth are confined as mentioned above, the absorption liquid is controlled preferentially by the deeper grooves and hence the absorption liquid can be stably spread in the longitudinal direction of the heat exchanger tube. As a result, the turbulence of the absorption liquid layer can be further promoted in the longitudinal direction of the heat exchanger tube and a more efficient heat exchange can be performed.

The width of the spiral grooves having a larger depth and a larger helix angle among all kinds of heat exchanger tubes should preferably be made larger than the width of other kinds of heat exchanger tubes. Because, if the depth of the spiral grooves is made larger than the width thereof, the absorption liquid layer can be easily spread in the longitudinal direction of the heat exchanger tube and at the same time the working to form such grooves can be easily accomplished.

(4) Spiral rib is formed on the inner surface of the heat exchanger tube in conformity with the shape of the spiral grooves which are the largest in depth among all kinds of spiral grooves formed on the outer surface of the heat exchanger tube.

When the spiral rib is formed in this manner on the inner surface of the heat exchanger tube in conformity with the shape of the spiral grooves having the largest depth among all kinds of spiral grooves on the outer surface of the heat exchanger tube, a turbulence may be caused to generate in the flow, for example, of a cooling water flowing inside the heat exchanger tube, thereby improving the performance of the inner surface of heat exchanger tube. At the same time, any superfluous thickness of the heat exchanger tube can be reduced, and hence the thickness of the tube can be reduced in the circumferential thereof, thus reducing the total weight of the tube and saving the manufacturing cost.

It is also possible to construct the heat exchanger tubes according to the first and second kinds of heat exchanger tubes in such a manner that one kind of the spiral grooves (i.e. a first kind of spiral grooves) among these plural kinds of spiral grooves are formed to have a depth which is not deep enough to cause the formation of a rib on the inner surface of the heat exchanger tube, while the other kind(s) of the spiral grooves (i.e. a second kind of spiral grooves) is deep enough to cause the formation of a rib on the inner surface of the heat exchanger tube in conformity with the location of the bottoms of the spiral grooves.

Namely, the second kind of the spiral grooves is accompanied with ribs protruding into the inner surface of the heat exchanger tube, i.e. so-called corrugate grooves. Accordingly, in the following description, this kind of spiral grooves will be referred to simply as "corrugate grooves", while the first kind of spiral grooves will be referred to simply as "spiral grooves" except otherwise specified.

If a heat exchanger tube provided on the outer surface thereof with aforementioned two kinds of grooves is horizontally mounted on an absorber, a turbulence can be generated in an absorption liquid at the intersection between the corrugate grooves and the spiral grooves. Since the corrugate grooves are formed in such a manner that they inevitably accompany the corresponding ribs on the inner surface of the heat exchanger tube, the depth thereof is larger than that of the spiral grooves.

Accordingly, non-uniformity in thickness of the absorption liquid is caused to be resulted on the outer surface of the heat exchanger tube, thus promoting the Marangoni convection.

Moreover, due to the presence of the ribs (which are originated from the corrugate grooves) on the inner surface of the heat exchanger tube, a cooling water flowing inside the tube is also disturbed, and hence the heat conductivity inside the tube can be also improved. As a result, a high heat exchange effect can be attained by the employment of this heat exchanger tube.

The depth of the spiral grooves should preferably be in the range of about 0.1 to 0.8 mm. If the depth of the spiral grooves is too shallow, it would be impossible to expect a sufficient turbulence in the absorption liquid layer. On the other hand, if the depth of the spiral grooves is too deep, the turbulence of the absorption liquid layer may be obstructed by the protruded portions formed between spiral grooves. The helix angle of the spiral grooves in relative to the longitudinal direction of the heat exchanger tube should preferably be in the range of about 3° to 80° though it may be varied depending on the helix angle of the corrugate grooves. If the helix angle is smaller than 3°, it may be difficult to effectively spread the absorption liquid in the circumferential of the heat exchanger tube. On the other hand, if the helix angle exceeds over 80°, the protrusions formed between the spiral grooves may become an obstacle to the movement of the absorption liquid layer in the longitudinal direction of the heat exchanger tube.

The sectional shape of the spiral grooves may be optionally selected, i.e. it may be triangular, trapezoidal or circular. The number of the corrugate grooves is dependent on the outer diameter of the tube to be employed. For example, in the case of the tube having a diameter of 19 mm, the number of the corrugate grooves may be in the range of 3 to 20. The pitch of the corrugate grooves in the circumferential of the tube may preferably be about 3 to 20 mm.

The helix angle of the corrugate grooves should be selected such that it differs from that of the spiral grooves.

If the helix angle of the corrugate grooves is identical with that of the spiral grooves, any intersection would be produced between the corrugate grooves and the spiral grooves, thus making it difficult to sufficiently promote the turbulence of the absorption liquid layer. The shape of the bottom of the corrugate grooves may be of acute angle or of curvature.

The followings are preferable embodiments of the heat exchanger tube comprising the aforementioned corrugate grooves.

(1) A heat exchanger tube where the helix angle of the corrugate grooves is smaller than the helix angle of the spiral grooves.

It is possible in this embodiment to effectively spread the absorption liquid layer along the corrugate grooves having a large groove depth and in the longitudinal direction of the tube, thereby making it possible to further improve the heat exchange performance of the heat exchanger tube.

(2) A heat exchanger tube where the twisting direction of the corrugate grooves is the same as that of the spiral grooves.

It is possible in this embodiment to effectively spread the absorption liquid layer in the longitudinal direction of the tube, thereby making it possible to further improve the heat exchange performance of the heat exchanger tube.

In the aforementioned various kinds of heat exchanger tubes, at least one kind of plural kinds of spiral grooves should preferably be shaped such that it is formed of a trapezoidal cross-sectional groove whose bottom (circular or linear) has a length of 0.1 to 1.0 mm and whose depth is in the range of 0.2 to 1.0 mm.

When at least one kind of plural kinds of spiral grooves is constructed in this manner, it is possible to separate the flow of the absorption liquid running over the outer surface of the tube into two directions, and to cause these separated flows of the absorption liquid to collide with each other at the intersection of grooves. As a result, the turbulence of the absorption liquid layer can be further promoted, thereby further improving the heat exchange performance.

This invention will be further explained with reference to the following various examples.

EXAMPLE 1

Figure 3:
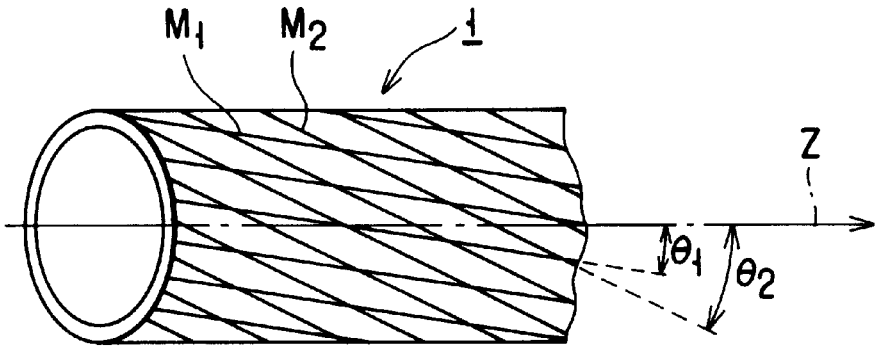
FIG. 3 is a perspective view showing a heat exchanger tube according to one embodiment of the present invention.

FIG. 3 shows a perspective view illustrating one example of the heat exchanger tube according to this invention. Referring to FIG. 3, a heat exchanger tube 1 is provided with two kinds of spiral grooves M1 and M2, whose helix angles θ1 and θ2 in relative to the axis Z of the tube are the same in direction with each other, but differ in magnitude.

The spiral grooves are shown as a single line for the sake of convenience in depicting the spiral grooves in this description. Further, a kind of grooves which is larger in groove depth is shown with a heavy line. These two kinds of spiral grooves M1 and M2 are the same with each other regarding the depth and pitch in the circumferential.

Since the heat exchanger tube according to this example is provided with two kinds of spiral grooves M1 and M2 whose helix angles in relative to the axis of the tube are the same in direction with each other but differ in magnitude, it is possible to promote the turbulence of an absorption liquid layer when this heat exchanger tube is employed in an absorber where heat exchanger tubes are horizontally arranged. To be more specific, because many a number of protrusions E0, each encircled by at least two kinds of spiral grooves M1 and M2, are formed on the outer surface of this heat exchanger tube, an absorption liquid layer is caused to be impinged upon these protrusions E0 thereby to promote the turbulence in the absorption liquid layer. At the same time, since these at least two kinds of spiral grooves M1 and M2 are twisted in the same direction in relative to the axis of the heat exchanger tube, the absorption liquid A0 thus disturbed by the protrusions E0 are allowed to sufficiently spread over the outer surface of the heat exchanger tube while crossing over the intercrossed portions of the spiral grooves M1 and M2, and at the same time the turbulence of the absorption liquid A0 can be sufficiently promoted also in the dropping direction of the absorption liquid A0 (a direction perpendicular to the longitudinal direction of the heat exchanger tube).

EXAMPLE 2

Figure 4:
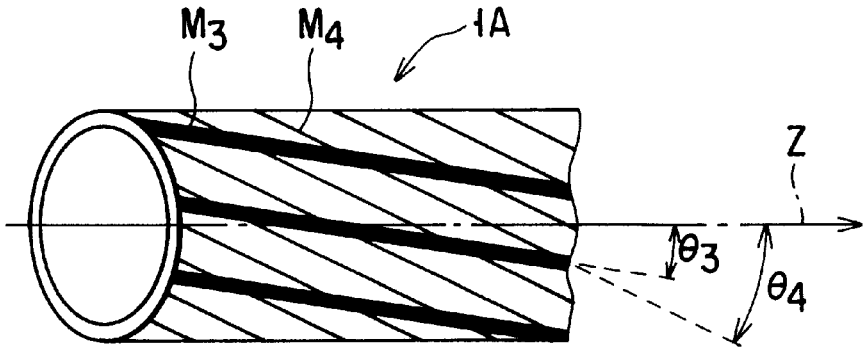
FIG. 4 is a perspective view showing a heat exchanger tube according to another embodiment of the present invention.

FIG. 4 shows a perspective view illustrating another example of the heat exchanger tube according to this invention. Referring to FIG. 4, a heat exchanger tube 1A is provided with two kinds of spiral grooves M3 and M4, whose helix angles θ3 and θ4 in relative to the axis Z of the tube are the same in direction with each other. However, the helix angle θ3 of the spiral groove M3 is made smaller than the helix angle θ4 of the spiral groove M4.

The depth of the spiral groove M3 as well as the pitch (in the circumferential of the tube) of the spiral groove M3 are made larger than those of the spiral groove M4.

EXAMPLE 3

Figure 5:
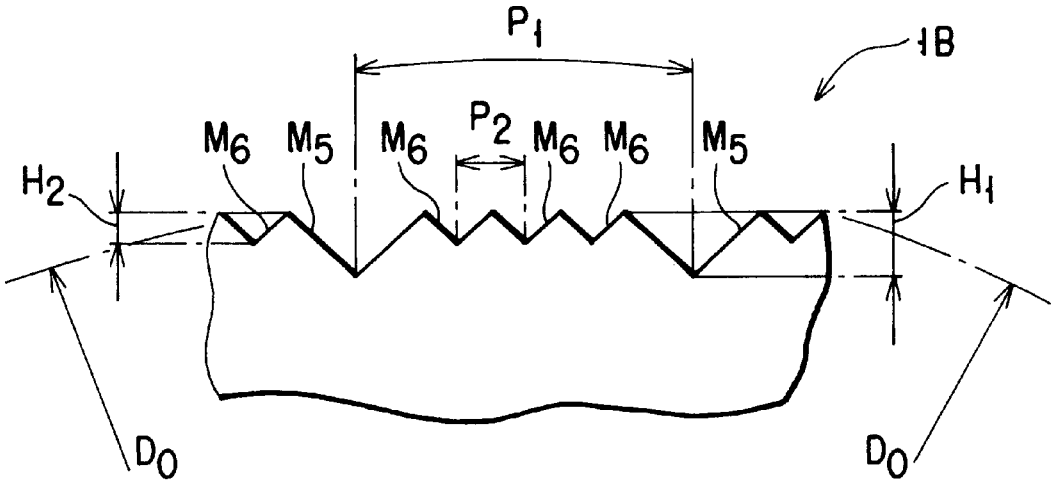
FIG. 5 is an enlarged sectioned view illustrating a main portion of a heat exchanger tube according to another embodiment of the present invention.

FIG. 5 shows an enlarged sectioned view illustrating a main portion of a heat exchanger tube according to another embodiment of the present invention. Referring to FIG. 5, a heat exchanger tube 1B is provided with two kinds of spiral grooves M5 and M6, whose helix angles in relative to the axis of the tube are the same in direction with each other. However, the helix angle of the spiral groove M5 is made smaller than the helix angle of the spiral groove M6.

The depth H1 of the spiral groove M5 as well as the pitch P1 (in the circumferential of the tube) of the spiral groove M5 are made larger than the depth H2 and the pitch P2 of the spiral groove M6.

The reference code D0 shown in FIG. 5 represents the outer diameter of the heat exchanger tube 1B.

A heat exchanger tube which is circular in cross-section is employed in the examples shown in FIGS. 3 to 5. However, the cross-section of the tube may be somewhat oval.

EXAMPLE 4

Figure 6:
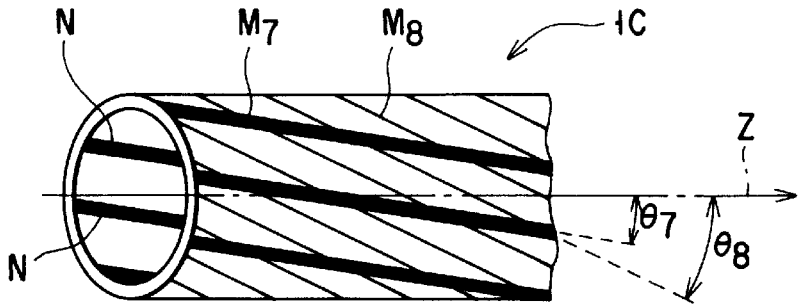
FIG. 6 is a perspective view showing a heat exchanger tube according to another embodiment of the present invention.

FIG. 6 shows a perspective view of a heat exchanger tube according to another embodiment of the present invention. Referring to FIG. 6, a heat exchanger tube 1C is provided with two kinds of spiral grooves M7 and M8, whose helix angles θ7 and θ8 in relative to the axis Z of the tube are the same in direction with each other. However, the helix angle θ7 of the spiral groove M7 is made smaller than the helix angle θ8 of the spiral groove M8 as in the case of the heat exchanger tube of Example 2.

The depth of the spiral groove M7 as well as the pitch (in the circumferential of the tube) of the spiral groove M7 are made larger than the depth and the pitch of the spiral groove M8.

The main feature of this heat exchanger tube according to this example resides in the inner surface of the heat exchanger tube. A spiral rib N is formed on the inner surface of the heat exchanger tube in conformity with the spiral groove M7, i.e. the location and shape of the spiral rib N coincide with those of the spiral groove M7.

In the aforementioned examples, the explanations are centered on the case where two kinds of spiral grooves differing in helix angle are formed on the outer surface of the heat exchanger tube. However, the spiral grooves are not necessarily consisted of two kinds of spiral grooves, but may be consisted of more than two kinds of spiral grooves as long as protrusions can be formed by the intersections of these spiral grooves.

A method of manufacturing the heat exchanger tube according to the first aspect of this invention will be explained as follows.

EXAMPLE 5

Figure 7A:
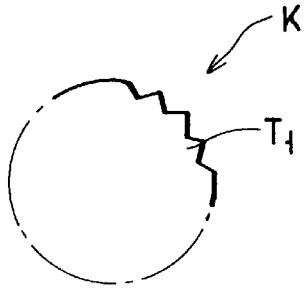
FIGS. 7A and 7B illustrate a front view and a cross-sectional view of a die to be employed in the manufacture of a heat exchanger tube of the present invention.
Figure 7B:
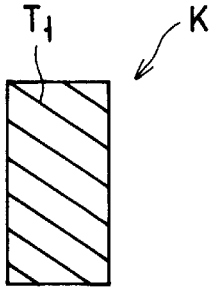

FIGS. 7A and 7B illustrate a die K to be employed for producing a spiral groove which is triangular in cross-section, wherein a plurality of ribs Ti each being triangular in slantwise cross-section are formed on the outer surface of the die K.

Figure 8A:
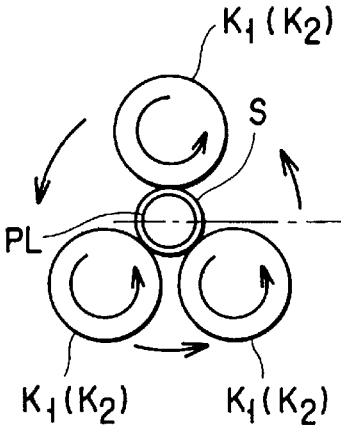
FIGS. 8A and 8B are schematic illustrations showing one example of manufacturing method of a heat exchanger tube of the present invention.
Figure 8B:
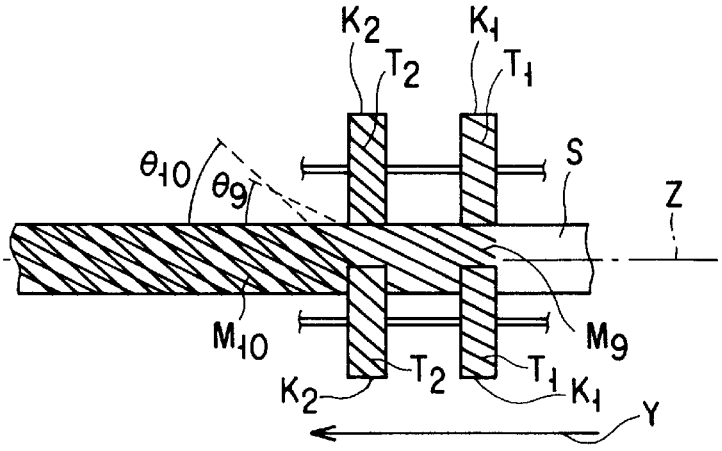

As shown in FIGS. 8A and 8B, a plural number of dies, e.g. three sets of dies in this example, each set of dies being consisted of two kinds of dies K1 and K2 provided respectively with ribs T1 and ribs T2 for forming two kinds of spiral grooves M9 and M10, and coaxially spaced apart by a predetermined distance from each other, are disposed on the smooth outer surface of a raw tube S in such a manner that these three sets of dies are positioned along the same peripheral surface portion of the raw tube S and in parallel with the axis Z of the raw tube.

A plug PL having a smooth outer surface is inserted into the inside of the raw tube S, and the dies K1 and K2 are allowed to rotate round the raw tube S while these dies are pressed onto the outer surface of the raw tube S. Concurrently, the raw tube S is drawn in the direction of Y so as to form a heat exchanger tube provided with two kinds of spiral grooves M9 and M10 whose helix angles θ9 and θ10 in relative to the axis Z of the tube are the same in direction with each other, but differ in magnitude.

In the example shown in FIGS. 8A and 8B, two kinds of dies K1 and K2 spaced apart along the working direction of the raw tube S are concurrently pressed onto the outer surface of the raw tube S. However, these dies K1 and K2 may be separated from each other and separately pressed onto the outer surface of the raw tube S.

Further, in the example shown in FIGS. 8A and 8B, three pieces of dies are employed for forming one kind of spiral grooves. However, preferable number of dies to be employed for forming one kind of spiral grooves is three to four. If the number of dies to be employed for forming one kind of spiral grooves is two or one, the drawing speed of the raw tube may be required to be reduced for forming desired spiral grooves, thus deteriorating the productivity.

On the other hand, if the number of dies to be employed for forming one kind of spiral grooves is five or more, the space for disposing these dies is required to be enlarged, thus making the apparatus excessive in size.

If three or more kinds of spiral grooves are to be formed, the corresponding number of dies are disposed equidistantly along the longitudinal direction of the raw tube, while limiting the number of dies for forming one kind of spiral grooves to three or to a suitable number, and then these dies are operated in the same manner as mentioned above.

When the heat exchanger tube of this invention is to be employed in an absorber, etc., a smooth surface portion for mounting an expansion tube or metal fittings for preventing the deflection may be required to be formed on the both end surface portion or on the middle surface portion of the tube. The formation of this smooth plain surface portion on the raw tube can be performed by temporarily detaching these dies from the surface of raw tube after finishing the formation of spiral grooves of predetermined length.

If plural kinds of spiral grooves which differ in groove depth and pitch in circumferential from each other are to be formed, the dies are arranged such that spiral grooves which are larger in depth can be formed at first. If spiral grooves of shallower depth are formed at first before the formation of deeper spiral grooves, the shallower spiral grooves may be collapsed at the occasion of forming deeper spiral grooves, thereby making it difficult to properly form the protrusions between the spiral grooves.

EXAMPLE 6

Figure 9A:
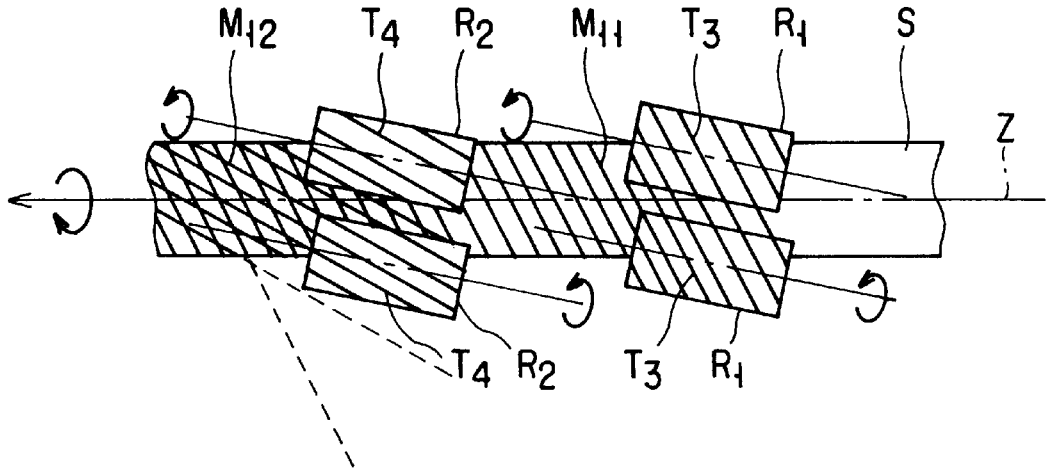
FIGS. 9A and 9B are schematic illustrations showing another example of manufacturing method of a heat exchanger tube of the present invention.
Figure 9B:
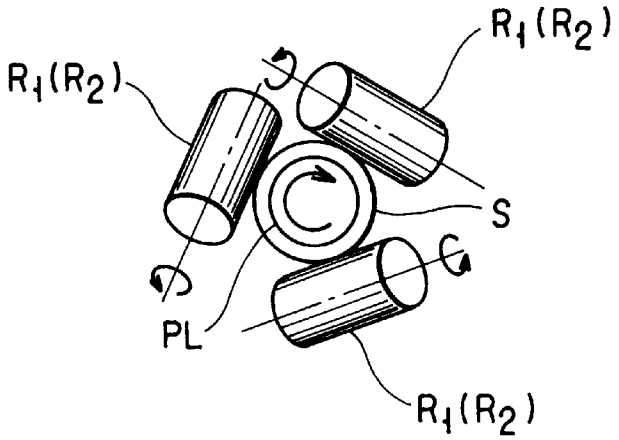

FIGS. 9A and 9B illustrate another example of manufacturing method of a heat exchanger tube according to the first aspect of the present invention.

Plural sets of rolls, each provided with ribs for forming predetermined kinds of spiral grooves, e.g. in this example, two sets of rolls, each set of rolls being consisted of three rolls R1 or R2 provided respectively with ribs T3 and ribs T4 for forming two kinds of spiral grooves M11 and M12 are separately disposed on the smooth outer surface of a raw tube S in such a manner that three dies in each set of dies are positioned equidistantly and slantwise (at a predetermined angle to the axis Z of the raw tube) along the same peripheral surface portion of the raw tube S.

Then, these two kinds of rolls R1 and R2 are pressed onto the outer surface of the raw tube S from three directions. On the other hand, a plug PL having a smooth outer surface is inserted into the inside of the raw tube S, and these two kinds of rolls R1 and R2 are allowed to rotate about their own axes while these rolls are pressed onto the outer surface of the raw tube S, thereby forming the spiral grooves M11 and M12.

In this case, the raw tube S is forced to move forward while being rotated by the driving force for forming these spiral grooves M11 and M12, thereby producing a heat exchanger tube provided with the spiral grooves M11 and M12.

The rotation of the rolls can be effected by driving at least one of the rolls. Namely, when one of the rolls is rotated, the raw tube S is caused to move in the working direction of the raw tube S by the driving force of this roll. Therefore, if other rolls are simply pressed onto the outer surface of the raw tube S, predetermined kinds of spiral grooves can be formed on the outer surface of the raw tube S by the rotations of aforementioned other rolls.

If three or more kinds of spiral grooves are to be formed in this manner, the corresponding number of rolls are disposed at a predetermined interval along the longitudinal direction of the raw tube, and then a heat exchanger tube provided with required number of spiral grooves can be manufactured in a single step as mentioned above.

EXAMPLE 7

Figure 10A:
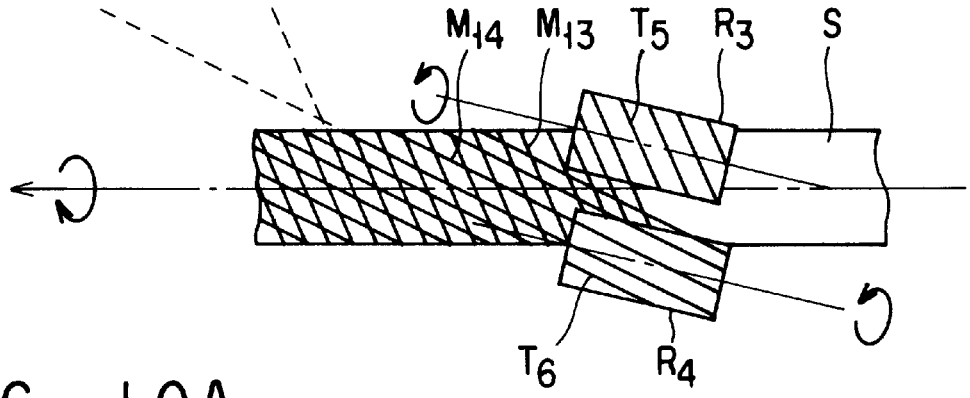
FIGS. 10A and 10B are schematic illustrations showing another example of manufacturing method of a heat exchanger tube of the present invention.
Figure 10B:
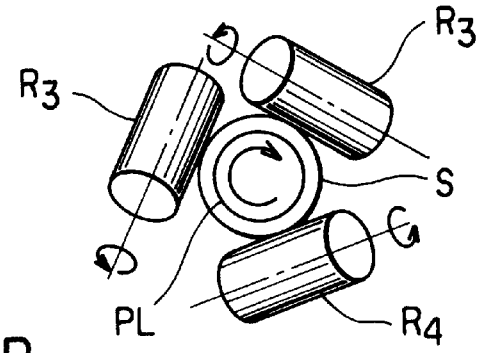

FIGS. 10A and 10B illustrate another example of manufacturing method of a heat exchanger tube according to the first aspect of the present invention.

The method of manufacturing the heat exchanger tube is applicable for the case where all of the spiral grooves on the outer surface of the heat exchanger tube are the same in groove depth with each other and the helix angle of some of them are different from that of the other ones.

A pair of rolls R3 each provided with ribs T5 of desired shape for forming spiral grooves M13 and one piece of roll R4 provided with ribs T6 of desired shape for forming spiral grooves M14 are disposed slantwise along the same peripheral surface portion of the raw tube S having a smooth outer surface, and then pressed onto the outer surface of the raw tube S from three directions. Concurrently, these two kinds of rolls R3 and R4 are allowed to rotate about their own axes while these rolls are pressed onto the outer surface of the raw tube S, thereby forming the spiral grooves M13 and M14 of the same groove depth.

In this example, two kinds of rolls each provided with ribs of desired shape for forming the spiral grooves are employed. However, two kinds of dies each provided with ribs of desired shape as shown in FIGS. 7A and 7B may be substituted for these rolls and disposed along the same peripheral surface portion of the raw tube S thereby to form the spiral grooves M13 and M14 of the same groove depth on the outer surface of the raw tube.

When rolling tools for forming spiral grooves are disposed along the same peripheral surface portion of the raw tube, the space for mounting the rolling tools can be reduced, thus making it possible to minimize the manufacturing apparatus as a whole.

However, it may be difficult with this arrangement of rolling tools to form plural kinds of spiral grooves differing in groove depth from one other. Because if the rolling tools are arrange in this manner, plural kinds of spiral grooves differing in groove depth are formed alternately, thus making it difficult to produce protrusions encircled by the spiral grooves.

According to aforementioned Examples 5 and 6, the inner surface of the heat exchanger tube is left in a state of smooth plain surface. However, it is also possible to form a spiral rib N on the inner surface of the heat exchanger tube in conformity with the spiral groove M7, i.e. in such a manner that the location and shape of the spiral rib N coincide with those of the spiral groove M7.

Figure 11:
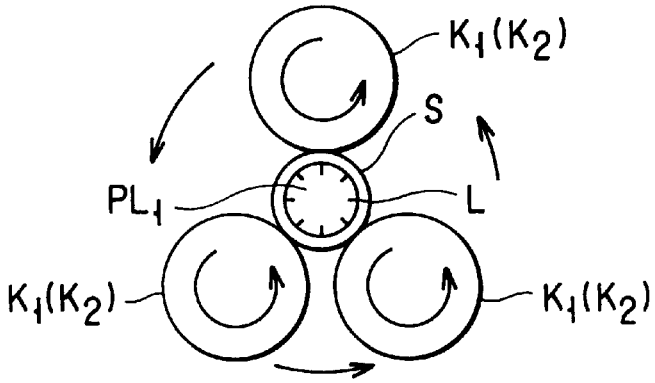
FIG. 11 is a side view illustrating another example of manufacturing method of a heat exchanger tube of the present invention.

In the aforementioned Example 5, the spiral grooves are formed by inserting a plug PL having a smooth outer surface into the interior of the raw tube S. However, as shown in FIG. 11, a plug PL1 provided on its outer surface with spiral grooves L corresponding in shape and location with the spiral groove M5 to be formed on the outer surface of the raw tube S may be employed. In this case, the plug PL1 is inserted into the interior of the raw tube S and then all of the dies K1 (K2) are rotated round the raw tube S while pressing these dies K1 (K2) onto the outer surface of the raw tube S, thus manufacturing a heat exchanger tube provided on its inner surface with the spiral grooves N.

Performance Test

Figure 12:
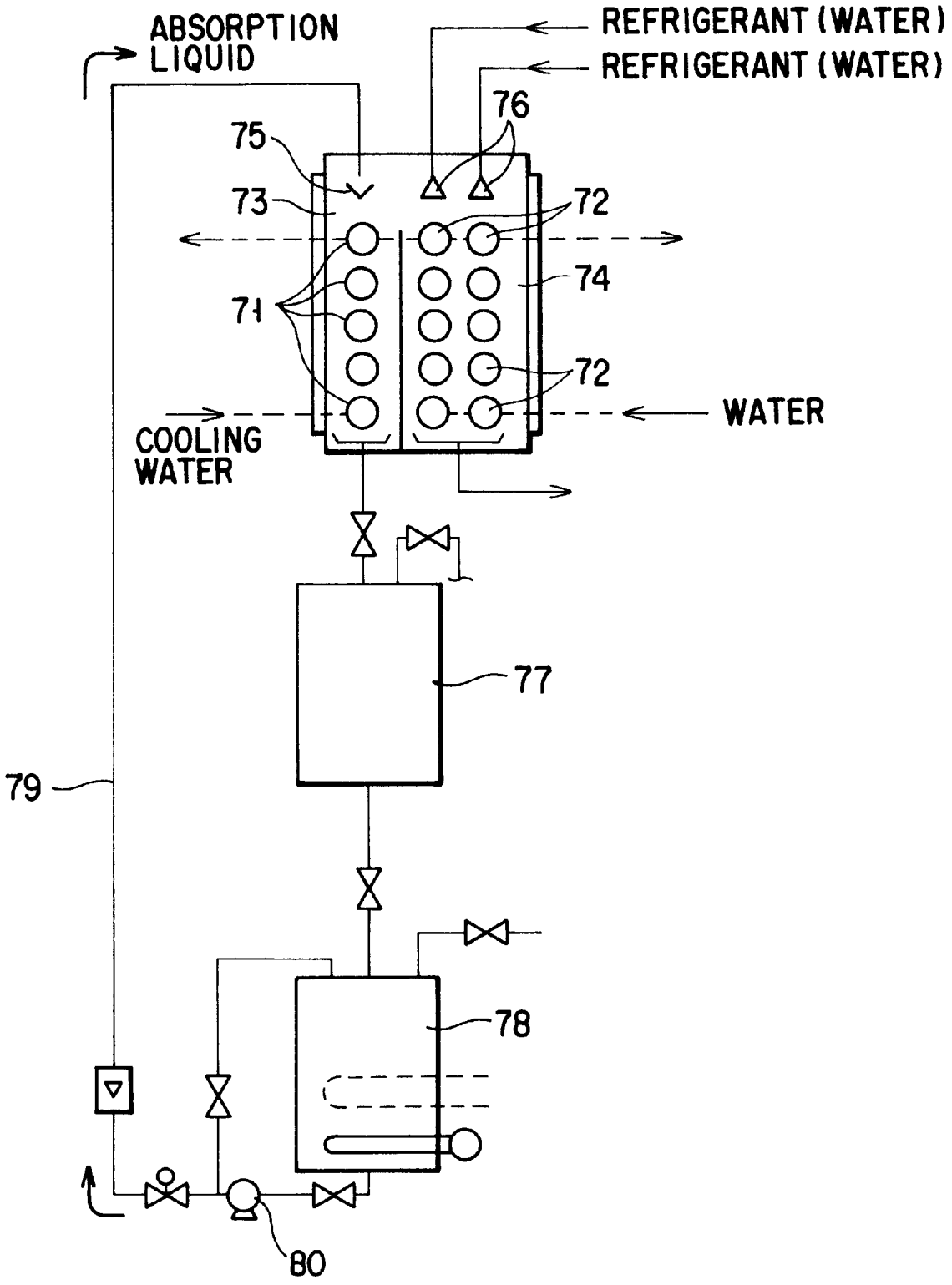
FIG. 12 is a schematic view illustrating a test machine for measuring the performance of a heat exchanger tube of the present invention.

The heat exchanger tubes 19.05 mm in outer diameter which have been manufactured according to the method explained in Example 5 and are provided with the features as shown in Tables 1 to 5 are employed in an absorber used as a testing apparatus as shown in FIG. 12 and heat exchange tests were performed. Likewise, a plain tube and heat exchanger tubes (hereinafter referred to as Comparative heat exchanger tubes) disclosed in Japanese Utility Model Unexamined Publication S/57-100161 were also employed and tested in the same manner as in the case of the heat exchanger tubes manufactured according to the method of Example 5.

Each of the dies employed for manufacturing the heat exchanger tubes of this invention is provided on its outer surface with a rib portion of desired shape and a groove portion of desired shape, the size of the die being 6 mm in thickness and 19.05 mm in diameter. Three pieces of this die were disposed around the outer peripheral surface of the tube for forming one kind of spiral grooves, and then operated. The shape of the spiral grooves to be formed is greatly influenced by the rotational speed of the dies and the drawing speed of the raw tube, but these conditions were controlled in this test to 1,000 rpm and 3.0 m/min., respectively.

The raw material of the heat exchanger tube used in this performance test was phosphorous deoxidized copper, which is generally employed as a material for a heat exchanger tube in an absorption refrigerator. By the way, other kinds of metals such as cupro-nickel or stainless steel have been also employed as a material for a heat exchanger tube depending on the requirements (such as a high temperature corrosion resistance) in an environment to which the heat exchanger tube is to be exposed. These metals are also useful in constructing the heat exchanger tube of this invention.

In order to examine the effectiveness of the structure of the heat exchanger tube of this invention, the test was performed according to the following five items, the results being indicated in Tables 1 to 5.

Table 1: Two kinds of spiral grooves are formed wherein the groove depth thereof is fixed constant, and only the helix angles thereof in relative to the axis of the heat exchange tube are changed to investigate any influence to the performance of the heat exchange tube. The results are shown in Table 1.

Table 2: Two kinds of spiral grooves are formed wherein the helix angles thereof in relative to the axis of the heat exchange tube are made different from each other, and the groove angles of both are made identical with each other but concurrently altered to investigate any influence to the performance of the heat exchange tube. The results are shown in Table 2.

Table 3: Two kinds of spiral grooves are formed wherein the groove depth thereof as well as the helix angles thereof in relative to the axis of the heat exchange tube are changed under the condition that two kinds of spiral grooves differ from each other in both groove depth and helix angle to investigate any influence to the performance of the heat exchange tube. The results are shown in Table 3.

Table 4: Three kinds of spiral grooves are formed to investigate any influence to the performance of the heat exchange tube. The results are shown in Table 4.

Table 5: The shape of cross-section of spiral grooves are varied to investigate any influence to the performance of the heat exchange tube. The results are shown in Table 5.

The test conditions were as shown below.

Absorption liquid:

An aqueous solution of LiBr

Concentration at the inlet: 58±0.5 wt %

Temperature at the inlet: 40±1° C.

Flow rate: 0.01 to 0.04 kg/m·s (the mass flow rate per unit length of an absorption liquid running on one side of the heat exchanger tube)

Surfactant: 250ppm of octyl alcohol was added

Absorption liquid sprinkler:

Pore size: 1.5 mm

Interval: 24 mm

Cooling water for the absorber:

Temperature at the inlet: 28±0.3° C.

Flowing speed: 2 m/s

Inner pressure of the absorber and the evaporator: 15±0.5 mmHg

The arrangement of heat exchanger tube: The heat exchanger tube 500 mm in length was horizontally arranged in five stages, each stage comprising one row of the tube.

The testing apparatus shown in FIG. 12 will now be briefly explained.

Referring to FIG. 12, the reference numeral 74 denotes an evaporator in which a plurality of heat exchanger tubes 72 are arranged in five stages, each stage comprising two rows of the tube 72. The neighboring upper and lower heat exchanger tubes 72 are communicated with each other, so that water can be circulated through these tubes 72. Refrigerant (pure water) is sprayed from spray pipes 76 onto these heat exchanger tubes 72. The reference numeral 73 represents an absorber, in which a plurality of sample tubes 71 to be tested are arranged in five stages, each stage comprising one row of the sample tube 71. The neighboring upper and lower sample tubes 71 are communicated with each other, so that cooling water can be circulated through these tubes 71. Absorption liquid (an aqueous solution of lithium bromide) is sprayed from spray pipes 75 onto these sample tubes 71.

The reference numeral 77 represents a dilute solution tank which is provided for storing an absorption liquid which has been diluted by the absorption of refrigerant vapor by the absorption liquid in the absorber 73. The absorption liquid in this dilute solution tank 77 is then transferred to a concentrating solution tank 78 and the concentration of the diluted absorption liquid is adjusted in this concentrating solution tank 78 by the addition of lithium bromide. The absorption liquid adjusted in this manner is then transferred via a pipe 79 to the spray pipe 75 by means of a pump 80, and again allowed to be sprayed from the spray pipe 75 onto the sample tubes 71.

The overall heat transfer coefficient and outside heat transfer coefficient of each sample tube of this invention were calculated based on the results obtained from this testing apparatus constructed as explained above.

Results measured of heat exchange performance

Tables 1 to 5 describe the results measured of heat exchange performances of each sample tube, i.e. the results being shown as a comparison in overall heat transfer coefficient and outside heat transfer coefficient between the sample tubes of this invention and the conventional heat exchanger tube, which are measured by setting the flow rate of the absorption liquid layer to 0.02 kg/m·s.

Figure 13:
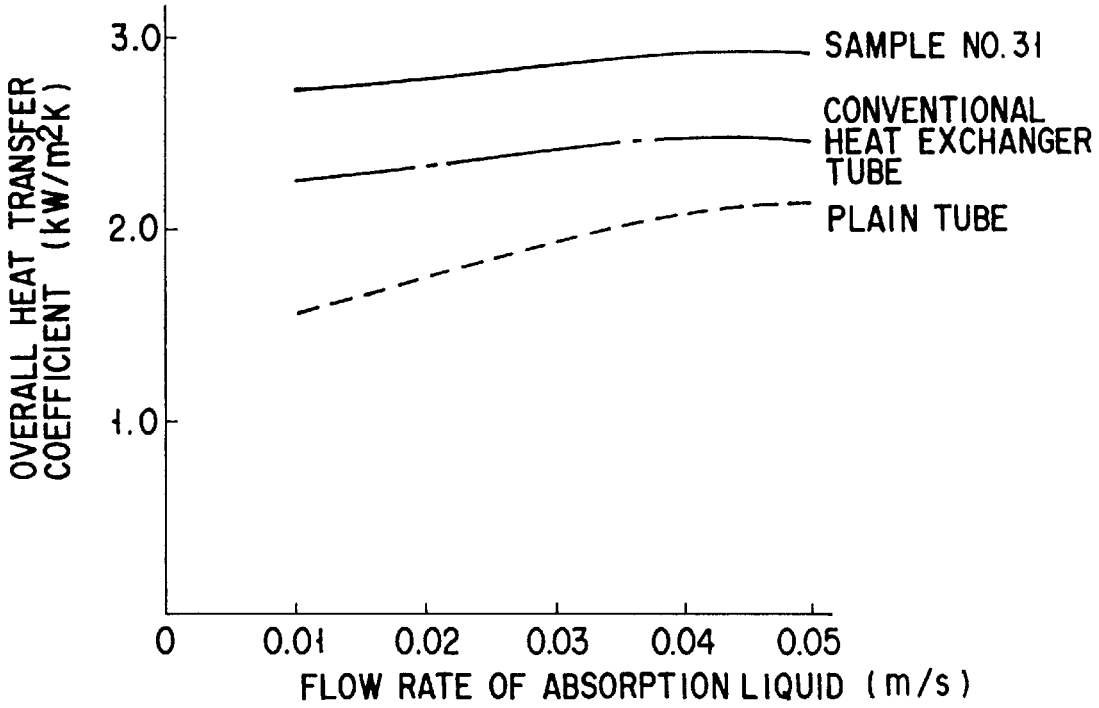
FIG. 13 is a graph illustrating the performance of a heat exchanger tube of the present invention.

As typical example, the measured results on the outside heat transfer coefficient of the sample 31 are described in FIG. 13.

As shown in the following Tables 1 to 5, the heat exchanger tubes of this invention where the helix angles of at least two kinds of spiral grooves are set to within the range of 3° to 80° exhibited far excellent heat exchange properties as compared with the conventional heat exchanger tubes.

TABLE 1

The features of the sample tubes which have been put to a heat exchange performance test (the influence of the helix angles of two kinds of spiral grooves)

| | Spiral groove 1 | | | | Spiral groove 2 | | | |
|---|---|---|---|---|---|---|---|---|
| Sample No. | Number of groove | Groove depth (mm) | Pitch (mm) | Helix angle (°) | Number of groove | Groove depth (mm) | Pitch (mm) | Helix angle (°) |
| Plain tube | | | | | | | | |
| Conventional heat exchange tube | 71 | 0.30 | 0.84 | 40 | | | | |
| 1 | 92 | 0.30 | 0.65 | 0 | 71 | 0.30 | 0.84 | 40 |
| 2 | 92 | 0.30 | 0.65 | 3 | 71 | 0.30 | 0.84 | 40 |
| 3 | 86 | 0.30 | 0.70 | 20 | 71 | 0.30 | 0.84 | 40 |
| 4 | 92 | 0.30 | 0.65 | 0 | 86 | 0.30 | 0.70 | 20 |
| 5 | 53 | 0.30 | 1.13 | 60 | 86 | 0.30 | 0.70 | 20 |
| 6 | 24 | 0.30 | 2.49 | 75 | 86 | 0.30 | 0.70 | 20 |
| 7 | 16 | 0.30 | 3.74 | 80 | 86 | 0.30 | 0.70 | 20 |
| 8 | 8 | 0.30 | 7.48 | 85 | 86 | 0.30 | 0.70 | 20 |
| 9 | 92 | 0.30 | 0.65 | 0 | 53 | 0.30 | 1.13 | 60 |

| | | Ratio of heat exchange performance as conventional tube being defined as 100 | | |
|---|---|---|---|---|
| Sample No. | Thickness of raw tube (mm) | Overall heat transfer coefficient | Outside heat transfer coefficient | |
| Plain tube | 0.6 | | | |
| Conventional heat exchange tube | 0.8 | 100 | 100 | Conventional example |
| 1 | 0.8 | 100 | 100 | Comparative example |
| 2 | 0.8 | 105 | 107 | This invention |
| 3 | 0.8 | 107 | 110 | This invention |
| 4 | 0.8 | 98 | 98 | Comparative example |
| 5 | 0.8 | 106 | 109 | This invention |
| 6 | 0.8 | 105 | 107 | This invention |
| 7 | 0.8 | 105 | 107 | This invention |

TABLE 1-continued

The features of the sample tubes which have been put to a heat exchange performance test (the influence of the helix angles of two kinds of spiral grooves)

| | | | | |
|---|---|---|---|---|
| 8 | 0.8 | 100 | 100 | Comparative example |
| 9 | 0.8 | 100 | 100 | Comparative example |

* The conventional heat exchanger tube was the one which is described in Japanese Utility Mode Unexamined Publication S/57-100161.
* The outer diameter of the raw tube was 19.05 mm and material thereof was phosphorus deoxidized copper.
* The cross-sectional shape of the spiral grooves was all triangular.

TABLE 2

The features of the sample tubes which have been put to a heat exchange performance test (the influence of the groove depth and pitch in peripheral direction of two kinds of spiral grooves)

| | Spiral groove 1 | | | | Spiral groove 2 | | | |
|---|---|---|---|---|---|---|---|---|
| Sample No. | Number of groove | Groove depth (mm) | Pitch (mm) | Helix angle (°) | Number of groove | Groove depth (mm) | Pitch (mm) | Helix angle (°) |
| Plain tube | | | | | | | | |
| Conventional heat exchange tube | 71 | 0.30 | 0.84 | 40 | | | | |
| 10 | 402 | 0.07 | 0.15 | 20 | 327 | 0.07 | 0.18 | 40 |
| 11 | 281 | 0.10 | 0.21 | 20 | 229 | 0.10 | 0.26 | 40 |
| 3 | 86 | 0.30 | 0.76 | 20 | 71 | 0.30 | 0.84 | 40 |
| 12 | 25 | 0.85 | 2.38 | 20 | 19 | 0.85 | 3.15 | 40 |
| 13 | 6 | 0.85 | 9.97 | 20 | 19 | 0.85 | 3.15 | 40 |
| 14 | 3 | 0.85 | 19.90 | 20 | 19 | 0.85 | 3.15 | 40 |
| 15 | 402 | 0.07 | 0.20 | 20 | 213 | 0.07 | 0.28 | 60 |
| 16 | 86 | 0.30 | 0.70 | 20 | 53 | 0.30 | 1.13 | 60 |
| 17 | 25 | 0.85 | 2.38 | 20 | 12 | 0.85 | 4.99 | 60 |
| 18 | 14 | 1.50 | 4.20 | 20 | 8 | 1.50 | 7.48 | 60 |
| 19 | 11 | 1.80 | 5.04 | 20 | 7 | 1.80 | 8.55 | 60 |

| | | Ratio of heat exchange performance as conventional tube being defined as 100 | | |
|---|---|---|---|---|
| Sample No. | Thickness of raw tube (mm) | Overall heat transfer coefficient | Outside heat transfer coefficient | |
| Plain tube | 0.6 | | | |
| Conventional heat exchange tube | 0.8 | 100 | 100 | Conventional example |
| 10 | 0.6 | 101 | 102 | This invention |
| 11 | 0.6 | 105 | 107 | This invention |
| 3 | 0.8 | 107 | 110 | This invention |
| 12 | 1.5 | 106 | 108 | This invention |
| 13 | 1.5 | 104 | 105 | This invention |
| 14 | 1.5 | 101 | 101 | This invention |
| 15 | 0.6 | 101 | 102 | This invention |
| 16 | 0.8 | 106 | 109 | This invention |
| 17 | 1.5 | 105 | 107 | This invention |
| 18 | 2.0 | 104 | 105 | This invention |
| 19 | 2.4 | 101 | 101 | This invention |

TABLE 3

The features of the sample tubes which have been put to a heat exchange performance test (the influence of the manner of combining two kinds of spiral grooves)

| Sample No. | Spiral groove 1 | | | | Spiral groove 2 | | | |
|---|---|---|---|---|---|---|---|---|
| | Number of groove | Groove depth (mm) | Pitch (mm) | Helix angle (°) | Number of groove | Groove depth (mm) | Pitch (mm) | Helix angle (°) |
| Plain tube | | | | | | | | |
| Conventional heat exchange tube | 71 | 0.30 | 0.84 | 40 | | | | |
| 20 | 106 | 0.20 | 0.56 | 40 | 281 | 0.10 | 0.26 | 20 |
| 21 | 71 | 0.30 | 0.84 | 40 | 281 | 0.10 | 0.26 | 20 |
| 22 | 49 | 0.50 | 1.22 | 40 | 86 | 0.30 | 0.70 | 20 |
| 23 | 49 | 0.50 | 1.22 | 40 | 42 | 0.30 | 1.68 | 20 |
| 24 | 42 | 0.30 | 1.68 | 40 | 86 | 0.30 | 0.70 | 20 |
| 25 | 49 | 0.50 | 1.22 | 40 | 71 | 0.30 | 0.84 | 40 |
| 3 | 86 | 0.30 | 0.70 | 20 | 71 | 0.30 | 0.84 | 40 |
| 26 | 19 | 0.85 | 3.15 | 40 | 49 | 0.50 | 1.22 | 20 |

| Sample No. | Thickness of raw tube (mm) | Ratio of heat exchange performance as conventional tube being defined as 100: Overall heat transfer coefficient | Outside heat transfer coefficient | |
|---|---|---|---|---|
| Plain tube | 0.6 | | | |
| Conventional heat exchange tube | 0.8 | 100 | 100 | Conventional example |
| 20 | 0.6 | 106 | 109 | This invention |
| 21 | 0.8 | 108 | 111 | This invention |
| 22 | 1.0 | 110 | 115 | This invention |
| 23 | 1.0 | 109 | 113 | This invention |
| 24 | 1.0 | 108 | 111 | This invention |
| 25 | 1.0 | 100 | 100 | Comparative example |
| 3 | 0.8 | 107 | 110 | This invention |
| 26 | 1.2 | 110 | 115 | This invention |

| Sample No. | Spiral groove 1 | | | | Spiral groove 2 | | | |
|---|---|---|---|---|---|---|---|---|
| | Number of groove | Groove depth (mm) | Pitch (mm) | Helix angle (°) | Number of groove | Groove depth (mm) | Pitch (mm) | Helix angle (°) |
| 27 | 12 | 1.50 | 4.99 | 40 | 30 | 0.70 | 1.96 | 20 |
| 28 | 12 | 1.50 | 4.99 | 40 | 25 | 0.85 | 2.38 | 20 |
| 29 | 10 | 1.80 | 5.98 | 40 | 30 | 0.70 | 1.96 | 20 |
| 30 | 229 | 0.10 | 0.26 | 40 | 86 | 0.30 | 0.76 | 20 |
| 31 | 71 | 0.30 | 0.84 | 40 | 25 | 0.85 | 2.38 | 20 |
| 32 | 53 | 0.30 | 1.13 | 60 | 49 | 0.50 | 1.22 | 20 |
| 33 | 30 | 0.70 | 1.96 | 40 | 14 | 1.50 | 4.20 | 20 |
| 34 | 63 | 0.30 | 0.95 | 45 | 25 | 0.85 | 2.38 | 30 |
| 35 | 53 | 0.30 | 1.13 | 60 | 25 | 0.85 | 2.38 | 40 |
| 36 | 71 | 0.30 | 0.84 | 40 | 25 | 0.85 | 2.38 | 20 |

| Sample No. | Thickness of raw tube (mm) | Ratio of heat exchange performance as conventional tube being defined as 100: Overall heat transfer coefficient | Outside heat transfer coefficient | |
|---|---|---|---|---|
| 27 | 2.0 | 105 | 111 | This invention |
| 28 | 2.0 | 105 | 107 | This invention |
| 29 | 2.0 | 105 | 106 | This invention |
| 30 | 0.8 | 111 | 116 | This invention |
| 31 | 1.2 | 116 | 124 | This invention |
| 32 | 0.9 | 116 | 124 | This invention |
| 33 | 2.0 | 110 | 115 | This invention |
| 34 | 1.2 | 112 | 118 | This invention |
| 35 | 1.2 | 109 | 113 | This invention |
| 36 | 0.9 | 123 | 124 | This invention |

* Only sample 36 is subjected to a rugged surface-forming treatment on its inner surface.

TABLE 4

The features of the sample tubes which have been put to a heat exchanged performance test (the influence of three kinds of spiral grooves)

| Sample No. | Spiral groove: Number of groove | Spiral groove: Groove depth (mm) | Spiral groove: Pitch (mm) | Spiral groove: Helix angle (°) | Thickness of raw tube (mm) | Ratio of heat exchange performance as conventional tube being defined as 100: Overall heat transfer coefficient | Ratio of heat exchange performance as conventional tube being defined as 100: Outside heat transfer coefficient | |
|---|---|---|---|---|---|---|---|---|
| Plain tube | | | | | 0.6 | | | |
| Conventional heat exchange tube | 71 | 0.30 | 0.84 | 40 | 0.8 | 100 | 100 | Conventional example |
| 37 | 89 | 0.30 | 0.67 | 15 | 0.8 | 107 | 110 | This invention |
| | 79 | 0.30 | 0.76 | 30 | | | | |
| | 63 | 0.30 | 0.95 | 45 | | | | |
| 38 | 25 | 0.85 | 2.38 | 20 | 1.2 | 113 | 119 | This invention |
| | 79 | 0.30 | 0.76 | 30 | | | | |
| | 63 | 0.30 | 0.95 | 45 | | | | |

TABLE 5

The features of the sample tubes which have been put to a heat exchange performance test (the influence of the cross-sectional shape of spiral grooves)

| Sample No. | Spiral groove 1: Number of groove | Spiral groove 1: Groove depth (mm) | Spiral groove 1: Pitch (mm) | Spiral groove 1: Helix angle (°) | Spiral groove 2: Number of groove | Spiral groove 2: Groove depth (mm) | Spiral groove 2: Pitch (mm) | Spiral groove 2: Helix angle (°) |
|---|---|---|---|---|---|---|---|---|
| Plain tube | | | | | | | | |
| Conventional heat exchange tube | 71 | 0.30 | 0.84 | 40 | | | | |
| 31 | 71 | 0.30 | 0.84 | 40 | 25 | 0.85 | 2.38 | 20 |
| 39 | 71 | 0.30 | 0.84 | 40 | 25 | 0.85 | 2.38 | 20 |
| 40 | 71 | 0.30 | 0.84 | 40 | 25 | 0.85 | 2.38 | 20 |

| Sample No. | Thickness of raw tube (mm) | Ratio of heat exchange performance as conventional tube being defined as 100: Overall heat transfer coefficient | Ratio of heat exchange performance as conventional tube being defined as 100: Outside heat transfer coefficient | |
|---|---|---|---|---|
| Plain tube | 0.6 | | | |
| Conventional heat exchange tube | 0.8 | 100 | 100 | Conventional example |
| 31 | 1.2 | 116 | 124 | This invention |
| 39 | 1.2 | 113 | 119 | This invention |
| 40 | 1.2 | 116 | 124 | This invention |

*In sample 31, the cross-sectional shape of all of the spiral grooves was all triangular.
*In sample 39, the cross-sectional shape of all of the spiral grooves was all semicircular (the diameter thereof was the same with the depth of the groove).
*In sample 40, the cross-sectional shape of all of the spiral grooves was all trapezoidal (the bottom width of spiral grooves 1 was 0.2 mm and the bottom of spiral grooves 2 was 0.45 mm)

It will be seen from Table 1 that if the helix angle of one kind of spiral grooves which is smaller in helix angle than the other kind of spiral grooves is confined to the range of 3° to 60° in relative to the axis of the tube, and at the same time the helix angle of the other kind of spiral grooves having a larger helix angle is confined to not more than 80° in relative to the axis of the tube, the overall heat transfer coefficient and outside heat transfer coefficient of the heat exchanger tube can be improved by 5% or more as compared with the conventional heat exchanger tube.

It will be seen from Table 2 that if the groove depth of the spiral groove is confined to the range of 0.1 to 1.5 mm, and at the same time the pitch of spiral grooves is confined to 0.2 to 10 mm, the overall heat transfer coefficient of the heat exchanger tube can be improved by 4% or more, and the outside heat transfer coefficient of the heat exchanger tube can be improved by 5% or more as compared with the conventional heat exchanger tube.

It will be seen from Table 3 that if the groove depth of the spiral groove, the pitch in circumferential, or both of these depth and pitch of one kind of the spiral grooves is made larger than the other kind of the spiral grooves, the overall heat transfer coefficient and outside heat transfer coefficient of the heat exchanger tube can be improved as compared with the case where both depth of the spiral groove and pitch in circumferential are the same in both kinds of spiral grooves.

In particular, if the groove depth of one kind of spiral grooves which is larger in groove depth than the other kind of spiral grooves is confined to the range of 0.3 to 1.5 mm, and the pitch thereof in the circumferential is confined to the range of 0.8 to 5.0 mm, and at the same time if the groove depth of the other kind of spiral grooves is confined to the range of 0.1 to 0.7 mm, and the pitch thereof in the circumferential is confined to the range of 0.5 to 2.0 mm, the overall heat transfer coefficient of the heat exchanger tube can be improved by 7% or more, and the outside heat transfer coefficient of thereof can be improved by 10% or more as compared with the comparative heat exchanger tube (Sample No. 25: the same in helix angle).

Moreover, it will be seen from Sample No. 30 to No. 35 shown in Table 3 that if at least the groove depth of one kind of spiral grooves which is smaller in helix angle than the other kind of spiral grooves is made larger than that of the other kind of spiral grooves, the overall heat transfer coefficient and outside heat transfer coefficient of the heat exchanger tube can be further improved as compared with the case where the depth of the spiral grooves having a larger helix angle in relative to the axis of the tube is made larger.

In particular, if the helix angle of one kind of spiral grooves which is smaller in helix angle than the other kind of spiral grooves is confined to 30° or less in Sample No. 30 to No. 35, the overall heat transfer coefficient of the heat exchanger tube can be improved by 10% or more, and the outside heat transfer coefficient of thereof can be improved by 15% or more as compared with the comparative heat exchanger tube.

It can be understood from the above experiments that if one kind of spiral grooves which is smaller in helix angle than the other kind of spiral grooves is formed such that the helix angle is confined to 3° to 30°, the groove depth is confined to 0.3 to 1.5 mm and the pitch in the circumferential is confined to 0.8 to 5.0 mm, and at the same time the other kind of spiral grooves is formed such that the groove depth thereof is made smaller than that of said one kind of spiral grooves having a smaller helix angle and selected from the range of 0.1 to 0.7 mm, and the pitch in the circumferential is confined to 0.25 to 2.0 mm, it is possible to optimize the heat exchange efficiency of the heat exchanger tube.

The width of the spiral grooves having a larger depth and a larger helix angle among all kinds of heat exchanger tubes should preferably be made larger than the width of other kinds of heat exchanger tubes. Because, if the depth of the spiral grooves is made larger than the width thereof, the absorption liquid layer can be easily spread in the longitudinal direction of the heat exchanger tube and at the same time the working to form such grooves can be easily accomplished.

Since Sample No. 31 is identical in outer appearance with Sample No. 36, the outside heat transfer coefficient thereof is the same as that of Sample No. 36. However, since Sample No. 31 is provided on the inner surface thereof with spiral rib in conformity with the shape of the spiral grooves which are larger in depth and pitch in the circumferential of the other kind of spiral grooves formed on the outer surface of the heat exchanger tube, a turbulence may be caused to generate in the flow of a cooling water flowing inside the heat exchanger tube, thereby improving the inside heat transfer coefficient. As a result, the overall heat transfer coefficient can be further improved and at the same time the thickness of the raw tube to be worked can be reduced.

Furthermore, it can be seen from the experiments described in Table 4 that even if three kinds of spiral grooves are formed on the outer surface of the tube, almost the same degree of improvement in performance as explained above can be obtained.

Further, it can be seen from the experiments described in Table 5 that irrespective in cross-sectional shape of spiral grooves, almost the same degree of turbulence can be caused to generate in an absorption liquid layer.

Application to a dropping liquid film type regenerator

In the above explanations, one example where the heat exchanger tube according to the first aspect of this invention is employed in an absorber among the heat exchangers of the absorption refrigerator. Meanwhile, in the case of a dropping liquid film type regenerator, a group of heat exchanger tubes are mounted horizontally as in the case of the absorber, and a dilute solution which has been diluted by absorbing refrigerant vapor in the absorber is dropped on the outer surface of the heat exchanger tube. At the same time, a hot water or water vapor is permitted to flow inside the tube, whereby boiling the dilute solution on the outer surface of the heat exchanger tube and increasing the concentration of the solution (restoring to the original concentration).

Therefore, the spreading or turbulence of absorption liquid layer on the outer surface of the heat exchanger tube is required in this dropping liquid film type regenerator as in the case of the heat exchanger tube to be employed in the absorber. Therefore, the spreading or turbulence of absorption liquid layer by the heat exchanger tube is also useful in the employment of the heat exchanger tube for this dropping liquid film type regenerator.

Application to an evaporator

The heat exchanger tube according to the first aspect of this invention is also useful as a heat exchanger tube for an evaporator. In the case of an evaporator of absorption refrigerator, a group of heat exchanger tubes are mounted in the same manner as in the cases of absorber and regenerator, and a refrigerant such as pure water is permitted to drop on the outer surface of the heat exchanger tube, and at the same time water is permitted to flow inside the tube.

Since the interior of the evaporator is kept at a reduced pressure, the refrigerant is evaporated on the outer surface of the heat exchanger tube. At this moment, the refrigerant takes heat from the water flowing inside the tube as a latent heat of vaporization, thus producing a chilled water.

Therefore, the outer surface of the heat exchanger tube is required to be constructed such that the refrigerant dropping along the outer surface of the heat exchanger tube can be readily spread out and the heat transfer area of the refrigerant on the outer surface of the heat exchanger tube is as large as possible.

When the heat exchanger tube according to the first aspect of this invention which is provided on the outer surface thereof with at least two kinds of spiral grooves which are the same in twisting direction in relative to the axis of the heat exchanger tube is employed as a heat exchanger tube for an evaporator, it is possible to uniformly spread the refrigerant along the spiral grooves and all over the outer surface of the heat exchanger tube, since a plurality of spiral grooves are twisted all in the same direction in relative to the axis of the tube. At the same time, since the heat transfer area is increased by the presence of the protrusions between the spiral grooves, a high heat exchange performance is expected to be obtained.

but differ in helix angle from each other, it is possible to promote the turbulence of an absorption liquid layer when this heat exchanger tube is employed in an absorber where heat exchanger tubes are horizontally arranged. To be more specific, because many a number of protrusions, each encircled by at least two kinds of spiral grooves, are formed on the outer surface of this heat exchanger tube, an absorption liquid layer is caused to be impinged upon these protrusions thereby to promote the turbulence in the absorption liquid layer.

As explained above, the heat exchanger tube according to the first aspect of this invention is capable of sufficiently spreading an absorption liquid on the outer surface of the heat exchanger tube, and at the same time capable of sufficiently promoting the turbulence of the absorption liquid in the dropping direction of the absorption liquid (a direction perpendicular to the longitudinal direction of the heat exchanger tube) as well as in the direction parallel to the longitudinal direction of the heat exchanger tube. Furthermore, since the this heat exchanger tube is constructed such that the turbulence of the absorption liquid can be sufficiently promoted, it is possible to provide a heat exchanger tube of high performance, thus contributing to the miniaturization and enhancement in performance of a refrigerator.

Furthermore, since the heat exchanger tube according to the first aspect of this invention is provided on the outer surface thereof with at least two kinds of spiral grooves which are the same in twisting direction in relative to the axis of the heat exchanger tube but differ in helix angle from each other, it is possible to promote the turbulence of an absorption liquid layer when this heat exchanger tube is employed in an absorber where heat exchanger tubes are horizontally arranged. Namely, since many a number of protrusions, each encircled by at least two kinds of spiral grooves, are formed on the outer surface of this heat exchanger tube, an absorption liquid layer is caused to be impinged upon these protrusions thereby to promote the turbulence in the absorption liquid layer. At the same time, since these at least two kinds of spiral grooves are twisted in the same direction in relative to the axis of the heat exchanger tube, the absorption liquid thus disturbed by the protrusions are allowed to sufficiently spread over the outer surface of the heat exchanger tube while crossing over the intercrossed portions of the spiral grooves.

Moreover, since the helix angle of these spiral grooves is confined to the range of 3° to 80° in relative to the axis of the heat exchanger tube, the turbulence of the absorption liquid can be further promoted, thus making it possible to attain a heat exchange of high efficiency.

In particular, if the difference in helix angle between these at least two kinds of spiral grooves is set to not less than 10°, it is possible to ensure the formation of the protrusions encircled by these spiral grooves and to promote the effect of the protrusions to disturb the absorption liquid layer.

In particular, if the depth of spiral grooves is confined to the range of 0.1 to 1.5 mm, and the pitch of spiral grooves in the circumferential to the range of 0.25 to 10 mm, the effect of the protrusions to disturb the absorption liquid layer would be promoted, thereby enabling the absorption liquid to run over these protrusions and to spread around the outer surface of the heat exchanger tube.

When at least one of at least two kinds of spiral grooves differs in either depth or pitch in circumferential, or in both depth and pitch from other kind(s) of spiral grooves, the following effects can be obtained.

Namely, the size of the protrusions on the outer surface of the heat exchanger tube becomes random, thus producing a difference in thickness of the absorption liquid layer. As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

In particular, if one kind of spiral grooves which is the largest in groove depth among at least two kinds of spiral grooves is designed to have a groove depth ranging from 0.3 to 1.5 mm and a pitch in circumferential ranging from 0.8 to 5.0 mm, while the other kind(s) of spiral grooves is designed to have a groove depth ranging from 0.1 to 0.7 mm and a pitch in circumferential ranging from 0.25 to 2.0 mm, an optimum difference in thickness of the absorption liquid layer is caused to be generated by the protrusions formed on the outer surface of the heat exchanger tube. As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

Furthermore, if the helix angle of one kind of spiral grooves which is the smallest in helix angle among all kinds of spiral grooves is confined to the range of 3° to 30° in relative to the axis of the heat exchanger tube, the absorption liquid layer can be stably spread along the longitudinal direction of the heat exchanger tube.

Further, if at least the groove depth of one kind of spiral grooves which is the smallest in helix angle among all kinds of spiral grooves is made larger than the groove depth of the other kind(s) of spiral grooves, the absorption liquid layer can be easily spread along the longitudinal direction of the heat exchanger tube. As a result, the turbulence of the absorption liquid can be further promoted in the longitudinal direction of the heat exchanger tube and a more efficient heat exchange can be performed.

In particular, if one kind of spiral grooves which is smallest in helix angle among all kinds of spiral grooves is formed such that the helix angle is confined to 3° to 30°, the groove depth is confined to 0.3 to 1.5 mm and the pitch in the circumferential is confined to 0.8 to 5.0 mm, and at the same time the other kind of spiral grooves is formed such that the groove depth thereof is made smaller than that of said one kind of spiral grooves having a smaller helix angle and selected from the range of 0.1 to 0.7 mm, and the pitch in the circumferential is confined to 0.25 to 2.0 mm, it is possible to optimize the aforementioned effects, and hence a more efficient heat exchange can be performed.

If spiral rib is formed on the inner surface of the heat exchanger tube in conformity with the shape of the spiral grooves which are the largest in depth among all kinds of spiral grooves formed on the outer surface of the heat exchanger tube, a turbulence may be caused to generate in the flow, for example, of a cooling water flowing inside the heat exchanger tube, thereby improving the performance of the inner surface of heat exchanger tube. At the same time, any superfluous thickness of the heat exchanger tube can be reduced, thus making the thickness of the tube as uniform as possible in the circumferential thereof, and hence reducing the total weight of the tube and saving the manufacturing cost.

Further, if a raw tube having a smooth outer surface is worked with plural kinds of rolling tools such as dies or rolls each having predetermined shape of spiral grooves, i.e. by rotating the rolling tools, while pressing these rolling tools onto the outer smooth surface of raw tube so as to form at least two kinds of spiral grooves, the time and trouble of exchanging the tools can be saved thereby improving the productivity.

If the above-mentioned heat exchanger tube is manufactured by a process wherein a raw tube having a smooth inner surface is worked by introducing a plug into the inside of the raw tube so as to form a corrugation on the inner surface of the tube in conformity with the shape of the spiral grooves which are the largest in depth among all kinds of spiral grooves formed on the outer surface of the tube, a turbulence can be generated in the flow, for example, of a cooling water flowing inside the heat exchanger tube, thereby improving the performance of the inner surface of heat exchanger tube.

Additionally, any superfluous thickness of the heat exchanger tube can be reduced, thus making the thickness of the tube as uniform as possible in the circumferential thereof, and hence reducing the total weight of the tube and saving the manufacturing cost.

Next, the second aspect of this invention will be explained with reference to the following various examples.

EXAMPLE 8

Figure 14:
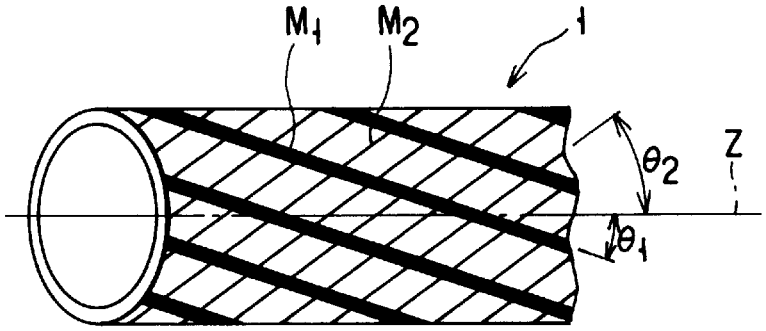
FIG. 14 is a perspective view showing a heat exchanger tube according to another embodiment of the present invention.

FIG. 14 shows a perspective view of a heat exchanger tube of one example according to the second aspect of the present invention. Referring to FIG. 14, a heat exchanger tube 1 is provided with two kinds of spiral grooves M1 and M2, whose helix angles θ1 and θ2 in relative to the axis Z of the tube are opposite in direction to each other, and differ in magnitude. Namely, in this example shown in FIG. 14, the helix angle θ1 is made smaller than the helix angle θ2. It should be noted that the magnitude of helix angle θ is expressed by an absolute value in relative to the axis Z irrespective of whether the helix angle θ is of right-handed helix or left-handed helix.

A heat exchanger tube which is circular in cross-section is employed in this example. However, the cross-section of the tube may be somewhat oval.

Figure 15:
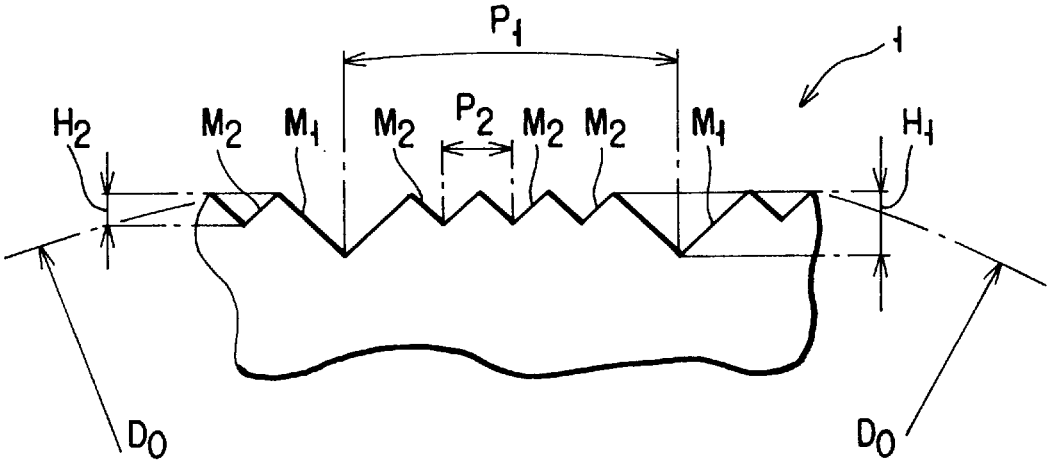
FIG. 15 is an enlarged sectioned view illustrating a main portion of a heat exchanger tube according to another embodiment of the present invention.

FIG. 15 shows an enlarged sectioned view of a main portion of a heat exchanger tube shown in FIG. 14. The spiral groove M1 formed on the outer surface of the heat exchanger tube 1 formed such that the groove depth H1 and the pitch P1 in circumferential are made larger than the groove depth H2 and the pitch P2 in circumferential of the spiral groove M2. The reference code D0 shown in FIG. 15 represents the outer diameter of the heat exchanger tube 1.

It has been found as a result of the following tests that the most preferable range of the helix angles θ1 and θ2 of the spiral grooves M1 and M2 in relative to the axis Z of the tube is from 3° to 80°. Further, it has been found as a result of the following tests that the most preferable range of the pitches P1 and P2 of the spiral grooves M1 and M2 in circumferential is from 0.3 to 4 mm. Further, it has been found as a result of the following tests that the most preferable range of the groove depths H1 and H2 of the spiral grooves M1 and M2 is from 0.1 to 1.5 mm. Further, it has been found as a result of the following tests that the difference in groove depth between the groove depths H1 and H2 of the spiral grooves M1 and M2 should most preferably be at least 1.15 times larger than the other one.

Specifically, the heat exchanger tube 1 is constructed such that the outer diameter D0 is 19.05 mm, the wall thickness thereof is 0.8 mm, the helix angle θ1 of the spiral groove M1 in relative to the axis Z is 15° in right hand direction, the groove depth H1 is 0.6 mm, the pitch P1 in the circumferential is 1.5 mm, the helix angle θ2 of the spiral groove M2 in relative to the axis Z is −30° in left hand direction (the left-handed helix will be hereinafter indicated by a minus sign), the groove depth H2 is 0.4 mm, and the pitch P2 in the circumferential is 1.0 mm.

Among these sizes, the groove depth of deeper spiral grooves is indicated by the original groove depth, even though the ridge portions of the deeper grooves may be collapsed by the formation of the shallower grooves. Therefore, the values in groove depth of deeper spiral grooves described in this example may differ from the actual groove depths.

EXAMPLE 9

Figure 16:
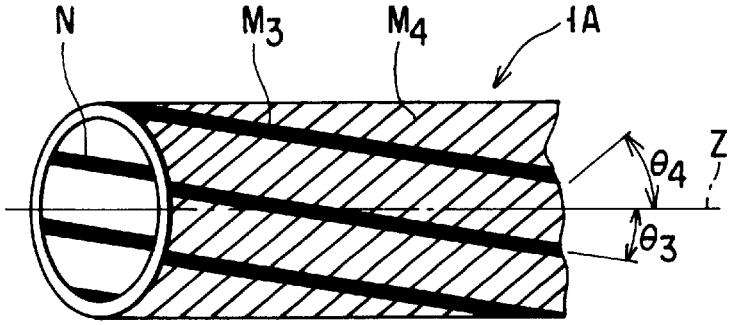
FIG. 16 is a perspective view showing a heat exchanger tube according to another embodiment of the present invention.

FIG. 16 shows a perspective view of a heat exchanger tube of another example according to the second aspect of the present invention. Referring to FIG. 16, a heat exchanger tube 1A is provided as in case of Example 8 with two kinds of spiral grooves M3 and M4, whose helix angles θ3 and θ4 in relative to the axis Z of the tube are opposite in direction to each other, and differ in magnitude. Namely, in this example, the helix angle θ3 of the groove M3 is made smaller than the helix angle θ4 of the groove M4.

The main feature of this heat exchanger tube according to this example resides in the inner surface of the heat exchanger tube. Namely, a spiral rib N is formed on the inner surface of the heat exchanger tube in conformity with the spiral groove M3, i.e. the location and shape of the spiral rib N coincide with those of the spiral groove M3.

In Examples 8 and 9, the explanations are centered on the case where two kinds of spiral grooves are formed on the outer surface of the heat exchanger tube. However, the spiral grooves are not necessarily consisted of two kinds of spiral grooves, but may be consisted of more than two kinds of spiral grooves as long as protrusions can be formed by the intersections of these spiral grooves.

The heat exchange performance these heat exchanger tubes were evaluated by using the testing apparatus shown in FIG. 12 and the same test conditions as employed in the examples according to the first aspect of this invention.

The raw tube made of phosphorous deoxidized copper and having an outer diameter of 19.05 mm was employed as the heat exchanger tube of this invention, thereby manufacturing the heat exchanger tubes shown in the following Tables 6 to 8 (Sample No. 41 to No. 53). Then, the evaluation of each sample was performed. By the way, although phosphorous deoxidized copper is generally employed as a material for a heat exchanger tube in an absorption refrigerator, other kinds of metals such as cupro-nickel or stainless steel have been also employed as a material for a heat exchanger tube depending on the requirements in an environment to which the heat exchanger tube is to be exposed. These metals are also useful in constructing the heat exchanger tube of this invention.

The overall heat transfer coefficient of each of the samples of heat exchanger tube of this invention is shown at the rightmost column of the following Tables 6 to 8.

As the conventional examples No.1 and No.2, heat exchanger tubes which are described in Japanese Utility Model Unexamined Publication S/57-100161 and Japanese Utility Model Unexamined Publication H/1-73663 respectively were prepared and evaluated.

TABLE 6

The features of the sample tubes which have been put to a heat exchange performance test (Comparison among varied helix angles)

| Sample No. | Spiral groove a | | | | Spiral groove b | | | |
|---|---|---|---|---|---|---|---|---|
| | Number of groove | Groove depth (mm) | Pitch (mm) | Helix angle (°) | Number of groove | Groove depth (mm) | Pitch (mm) | Helix angle (°) |
| Conventional example 1 | 71 | 0.30 | 0.84 | 40 | | | | |
| Conventional example 2 | 52 | 0.40 | 1.15 | 30 | 52 | 0.40 | 1.15 | −30 |
| Comparative example 1 | 40 | 0.60 | 1.50 | 0 | 52 | 0.40 | 1.15 | −30 |
| 41 | 40 | 0.60 | 1.50 | 3 | 52 | 0.40 | 1.15 | −30 |
| 42 | 39 | 0.60 | 1.50 | 15 | 52 | 0.40 | 1.15 | −30 |
| 43 | 28 | 0.60 | 2.14 | 45 | 52 | 0.40 | 1.15 | −30 |
| 44 | 10 | 0.62 | 8.54 | 75 | 52 | 0.40 | 1.15 | −30 |
| Comparative example 2 | 8 | 0.60 | 11.97 | 78 | 52 | 0.40 | 1.15 | −30 |

| Sample No. | Thickness of raw tube (mm) | Overall heat transfer coefficient in comparison with that of conventional tube |
|---|---|---|
| Conventional example 1 | | 100 |
| Conventional example 2 | $t_{0.7}$ | 100 |
| Comparative example 1 | $t_{0.8}$ | 100 |
| 41 | $t_{0.8}$ | 105 |
| 42 | $t_{0.8}$ | 112 |
| 43 | $t_{0.8}$ | 109 |
| 44 | $t_{0.8}$ | 103 |
| Comparative example 2 | $t_{0.8}$ | 100 |

TABLE 7

The features of the sample tubes which have been put to a heat exchange performance test (Comparison among varied helix depths)

| Sample No. | Spiral groove a | | | | Spiral groove b | | | |
|---|---|---|---|---|---|---|---|---|
| | Number of groove | Groove depth (mm) | Pitch (mm) | Helix angle (°) | Number of groove | Groove depth (mm) | Pitch (mm) | Helix angle (°) |
| 45 | 16 | 1.45 | 3.74 | 15 | 52 | 0.40 | 1.15 | −30 |
| 46 | 20 | 1.16 | 2.99 | 15 | 52 | 0.40 | 1.15 | −30 |
| 48 | 50 | 0.46 | 1.20 | 15 | 52 | 0.40 | 1.15 | −30 |
| Conventional example 2 | 58 | 0.40 | 1.15 | 15 | 52 | 0.40 | 1.15 | −30 |
| 49 | 66 | 0.35 | 0.91 | 15 | 52 | 0.40 | 1.15 | −30 |
| 50 | 90 | 0.26 | 0.66 | 15 | 52 | 0.40 | 1.15 | −30 |
| 51 | 116 | 0.20 | 0.52 | 15 | 52 | 0.40 | 1.15 | −30 |
| 52 | 154 | 0.15 | 0.39 | 15 | 52 | 0.40 | 1.15 | −30 |

| Sample No. | Thickness of raw tube (mm) | Overall heat transfer coefficient in comparison with that of conventional tube |
|---|---|---|
| 45 | $t_{1.2}$ | 110 |
| 46 | $t_{1.1}$ | 113 |
| 48 | $t_{0.8}$ | 106 |
| Conventional | $t_{0.8}$ | 100 |
| example 2 | $t_{0.7}$ | 105 |
| 49 | $t_{0.7}$ | 105 |
| 50 | $t_{0.7}$ | 110 |
| 51 | $t_{0.7}$ | 108 |
| 52 | $t_{0.7}$ | 105 |

TABLE 8

The features of the sample tubes which have been put to a heat exchange performance test (Comparison among varied helix angles in absolute value)

| | Spiral groove a | | | | Spiral groove b | | | |
|---|---|---|---|---|---|---|---|---|
| Sample No. | Number of groove | Groove depth (mm) | Pitch (mm) | Helix angle (°) | Number of groove | Groove depth (mm) | Pitch (mm) | Helix angle (°) |
| 47 | 30 | 0.77 | 1.99 | 15 | 52 | 0.40 | 1.15 | −30 |
| 53 | 27 | 0.77 | 2.22 | 30 | 52 | 0.40 | 1.15 | −30 |

| Sample No. | Thickness of raw tube (mm) | Overall heat transfer coefficient in comparison with that of conventional tube |
|---|---|---|
| 45 | $t_{0.9}$ | 114 |
| 46 | $t_{0.7}$ | 110 |

It will be determined from the results obtained by measuring the Sample Nos. 41 to 44 and Comparative Examples 1 and 2 shown in Table 6 in what manner the helix angle θ in relative to the axis of the tube gives an influence to the performance of the tube.

Figure 17:
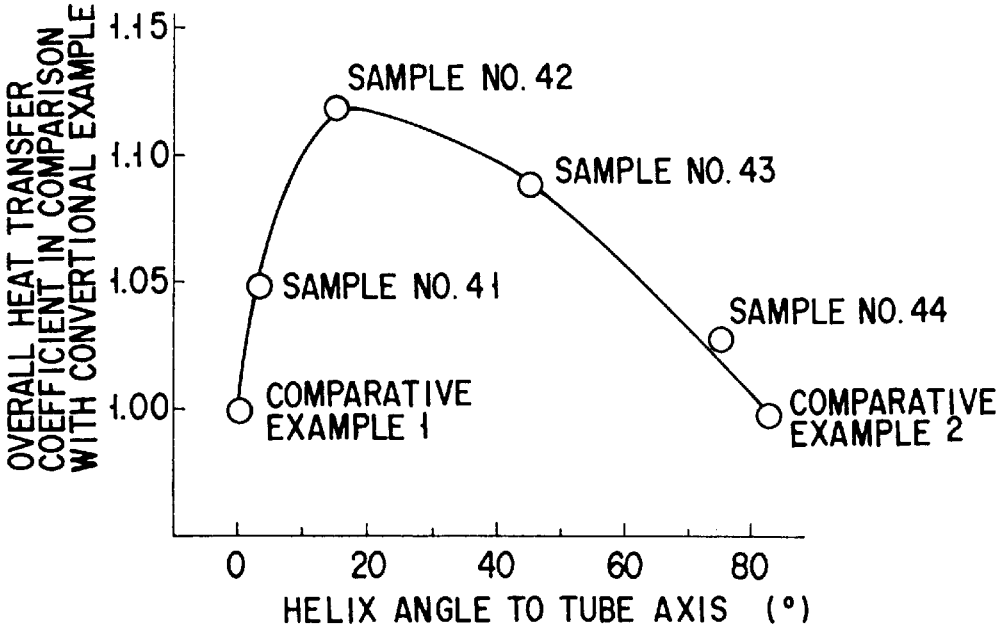
FIG. 17 is a graph illustrating the performance of a heat exchanger tube according to another embodiment of the present invention.

FIG. 17 is a graph wherein the abscissa axis represents the helix angle and the ordinate axis represents the ratio of overall heat transfer coefficient in relative to that of the conventional heat exchanger tube. As seen from FIG. 17, if the helix angle θ in relative to the axis of the tube is in the range of 3° to 80°, the overall heat transfer coefficient can be improved. Most preferable range of the helix angle θ of the spiral grooves which are larger in groove depth is 15° to 45°. As apparent from the comparison between Sample No. 42 and Sample No. 43 of this invention, when the absolute value of helix angle of the spiral grooves which are larger in groove depth is smaller than that of the other kind of spiral grooves, the overall heat transfer coefficient can be further improved.

It will be determined from the results obtained by measuring the Sample Nos. 45 to 52 and Conventional Example 2 shown in Table 7 in what manner the groove depth or the groove pitch P gives an influence to the performance of the tube.

Figure 18:
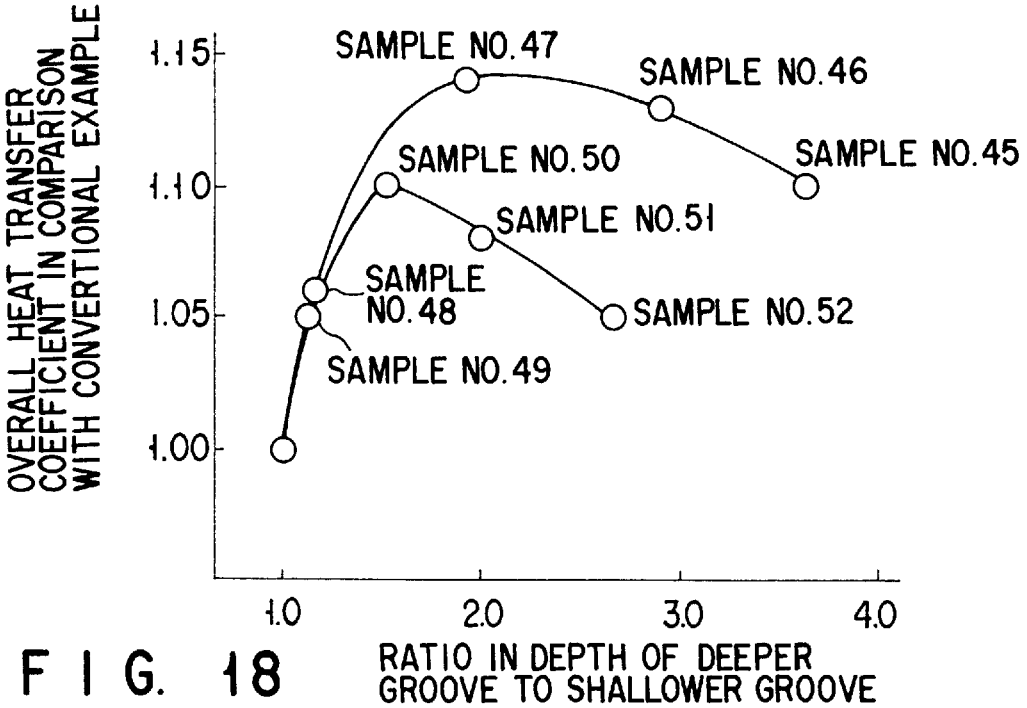
FIG. 18 is a graph illustrating the performance of a heat exchanger tube according to another embodiment of the present invention.

FIG. 18 is a graph wherein the abscissa axis represents the ratio of the groove depth of the deeper grooves in relative to the groove depth of the shallower grooves, i.e. the value of groove depth of the deeper grooves when the value of groove depth of the shallower grooves is defined as being 1, and the ordinate axis represents the ratio of overall heat transfer coefficient in relative to that of the conventional heat exchanger tube.

As seen from FIG. 18, the sample tubes of this invention exhibited an increased overall heat transfer coefficient as compared with that of the Conventional Example 2. Furthermore, it will be seen that the overall heat transfer coefficient can be further improved if the ratio of the groove depth is 1.15 times or more. Further, it will be seen from Table 7 that when the groove depth is limited to the range of 0.1 to 1.5 mm and the groove pitch is limited to the range of 0.3 to 4.0 mm, the overall heat transfer coefficient can be improved by 5% or more. If the groove depth and groove pitch are smaller than the lower limits defined above, it will be difficult to expect a sufficient turbulence of the absorption liquid layer that can be effected by the protrusions. On the other hand, if the groove depth and groove pitch are larger than the upper limits defined above, the protrusions formed between the spiral grooves may become an obstacle to the generation of turbulence in the absorption liquid layer, thereby making it difficult to expect any improvement in heat exchange performance of the tube.

Since the difference in groove depth is required to be larger than 1.15 times, the depth of the deeper spiral grooves should preferably be set to the range of 0.15 to 1.5 mm and the depth of the shallower spiral grooves should preferably be set to the range of 0.1 to 1.3 mm.

The sectional shape of the spiral grooves may be optionally varied as long as the sectional shape meets the aforementioned conditions, i.e. it may be triangular, trapezoidal, circular or elongated in the longitudinal direction of the tube. The number of the corrugate grooves is dependent on the outer diameter of the tube to be employed. For example, in the case of the tube having a diameter of 19 mm, the number of the corrugate grooves may be in the range of 3 to 20. The pitch of the corrugate grooves in the circumferential of the tube may preferably be about 3 to 20 mm.

As apparent from the comparison between Sample No. 47 and Sample No. 53 shown in Table 8, when the helix angle of two kinds of spiral grooves differs from each other, the heat exchange performance of the tube can be further improved.

It can be understood from the above experiments that the structure of the spiral grooves which is desirable in achieving an excellent heat exchange performance of the heat exchange according to the second aspect of this invention should preferably be designed such that the absolute value of helix angle of one of two or more kinds of spiral grooves in relative to the axis of the tube is set to smaller than the other kind(s) of spiral grooves, and at the same time, the groove depth is confined to 0.1 to 1.5 mm.

The width of the spiral grooves having a larger depth and a larger helix angle among all kinds of heat exchanger tubes should preferably be made larger than the width of other kinds of heat exchanger tubes. Because, if the depth of the spiral grooves is made larger than the width thereof, the absorption liquid layer can be easily spread in the longitudinal direction of the heat exchanger tube and at the same time the working for forming such grooves can be easily accomplished.

The above explanations are centered on one example where the heat exchanger tube according to the second aspect of this invention is employed in an absorber of the absorption refrigerator. Meanwhile, in the case of an evaporator or dropping liquid film type regenerator of absorption refrigerator, a group of heat exchanger tubes are mounted horizontally as in the case of the absorber, and a liquid is gravitationally dropped or sprayed from the top onto the outer surfaces of the heat exchanger tubes one after another.

Therefore, when the heat exchanger tube of this invention is mounted on an evaporator or on a dropping liquid film type regenerator, the spreading or turbulence of a refrigerant or solution in these evaporator and dropping liquid film type regenerator can be also effected as in the case of the aforementioned absorber. Namely, the heat exchanger tube according to the second aspect of this invention is also useful as a high performance heat exchanger tube of these evaporator and dropping liquid film type regenerator.

Since the heat exchanger tube according a second aspect of this invention is featured in that it is provided with at least two kinds of spiral grooves, each being formed on an outer surface of the heat exchanger tube, wherein a twisting direction of one kind of spiral grooves in relative to the axis of the heat exchanger tube is opposite to that of other kind(s) of spiral grooves, the helix angles of all kinds of spiral grooves fall within the range of 3° to 80° in relative to the axis of the heat exchanger tube, and at least one kind of spiral grooves among at least two kinds of spiral grooves differs in depth from other kind(s) of spiral grooves as mentioned above, many a number of protrusions each encircled by at least two kinds of spiral grooves can be formed on the outer surface of the heat exchanger tube and hence it is possible to allow the absorption liquid to impinge upon these protrusions, thereby promoting the turbulence of an absorption liquid layer. Moreover, since these at least two kinds of spiral grooves are twisted in the opposite direction in relative to the axis of the heat exchanger tube, the absorption liquid thus disturbed by the protrusions are allowed to sufficiently spread over the outer surface of the heat exchanger tube while crossing over the intercrossed portions of the spiral grooves, and at the same time the turbulence of the absorption liquid can be sufficiently promoted also in the dropping direction of the absorption liquid (a direction perpendicular to the longitudinal direction of the heat exchanger tube).

Furthermore, if the helix angle of these spiral grooves is confined to the range of 3° to 80° in relative to the axis of the heat exchanger tube and the absorption liquid is forced to run in opposite ways, i.e. an absorption liquid flow running along a deep groove and another absorption liquid flow running along a shallow groove whose direction is opposite to that of the deep groove, the absorption liquid layer of lower concentration running along a shallow groove and the absorption liquid layer of higher concentration running along a deep groove are caused to collide with each other. As a result, any non-uniformity in concentration between the upper layer of the absorption liquid and lower layer of the absorption liquid can be minimized, and at the same time the interfacial turbulence can be produced more frequently in the absorption liquid.

Therefore, the heat exchange performance of the heat exchanger tube can be greatly improved, resulting in a prominent improvement in performance of an heat exchanger provided with this heat exchanger tube.

Further, if at least one kind among at least two kinds of spiral grooves is directed opposite in twisting direction to other kind(s) of spiral grooves in relative to the axis of the heat exchanger tube and if, at the same time, the absolute values in helix angle, in relative to the axis of the heat exchanger tube, of at least two kinds of spiral grooves differs from each other, the flow of the absorption liquid on the outer surface of the heat exchanger tube can be varied, i.e. the absorption liquid layer running along spiral grooves of smaller helix angle is induced to flow along the longitudinal direction of the tube, while the absorption liquid layer running along spiral grooves of larger helix angle functions to control the flow of absorption liquid to be directed in a fixed circumferential. As a result, the heat exchanging performance by the heat exchanger tube can be further promoted by this synergistic effect.

Further, if the groove depth of spiral grooves is confined to a range of from 0.1 to 1.5 mm and the pitch in circumferential thereof to range from 0.3 to 4 mm, while a difference in groove depth of among these at least two kinds of spiral grooves is set to 1.15 times or more as measured based on a shallower group of spiral grooves, an optimum result can be obtained as explained below.

Namely, if the depth and pitch of spiral grooves are less than the aforementioned lower limits, the effect of the protrusions to disturb the absorption liquid layer cannot be sufficiently attained, while if the depth and pitch of spiral grooves exceed over the aforementioned upper limits, it may become difficult for the absorption liquid to run over these protrusions and to spread around the outer surface of the heat exchanger tube.

If a difference in groove depth of among these at least two kinds of spiral grooves is set to 1.15 times or more as measured based on a shallower group of spiral grooves, the protrusion to be formed on the outer surface of the heat exchanger tube can be optimized in relative to the thickness of the absorption liquid.

As a result, the surface tension of the absorption liquid is caused to become irregular, thus promoting the Marangoni convection, and hence the turbulence of the absorption liquid can be further promoted and a more efficient heat exchange can be attained as compared with the heat exchanger tube where only spiral grooves of the same size are formed thereon.

Furthermore, if the helix angle of at least two kinds of spiral grooves is confined to a range of from 15° to 45° with a proviso that the absolute value of helix angle of one of at least two kinds of spiral grooves in relative to the axis of the tube is set to smaller than the other kind(s) of spiral grooves, and if, at the same time, the groove depth thereof is confined to a range of from 0.1 to 1.5 mm, the absorption liquid can be controlled preferentially by the deeper grooves and hence the absorption liquid can be stably spread in the longitudinal direction of the heat exchanger tube. As a result, the turbulence of the absorption liquid layer can be further promoted in the longitudinal direction of the heat exchanger tube and a more efficient heat exchange can be performed.

Furthermore, if a spiral rib is formed on the inner surface of the heat exchanger tube in conformity with the shape of the spiral grooves which are the largest in depth among all kinds of spiral grooves formed on the outer surface of the heat exchanger tube, a turbulence may be caused to generate in the flow of a cooling water flowing inside the heat exchanger tube, thereby improving the performance of the inner surface of heat exchanger tube. At the same time, any superfluous thickness of the heat exchanger tube can be reduced, and hence the thickness of the tube can be reduced in the circumferential thereof, thus reducing the total weight of the tube and saving the manufacturing cost.

Next, this invention will be explained with reference to the following examples describing various modifications of this invention.

EXAMPLE 10

Figure 19A:
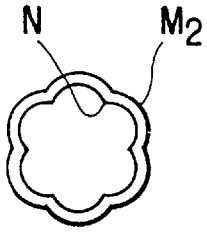
FIGS. 19A and 19B are views showing a heat exchanger tube according to another embodiment of the present invention.

FIG. 19A schematically illustrates one example of a heat exchanger tube according this present invention, and FIG.

Figure 19B:
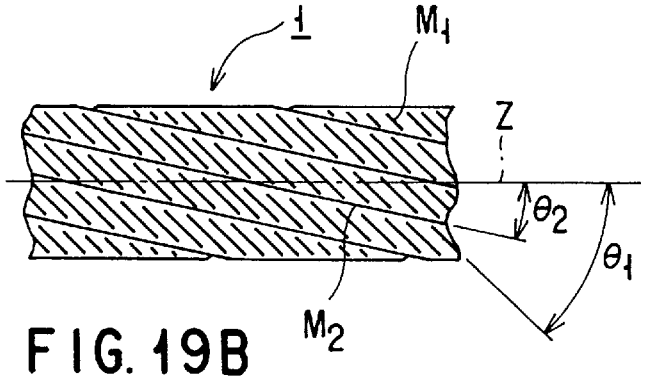
Figure 19C:
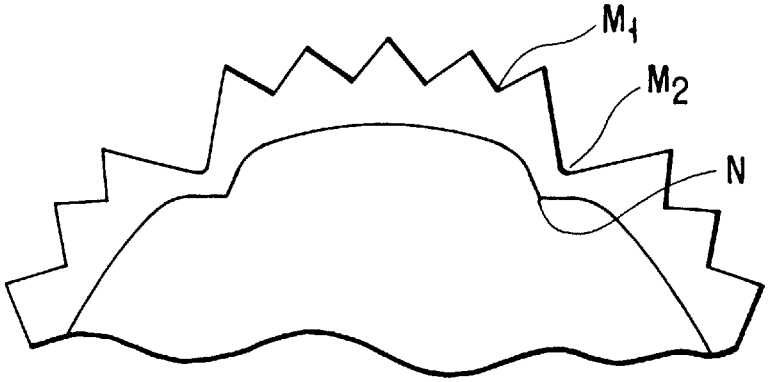
FIG. 19C is an enlarged sectioned view illustrating a main portion of a heat exchanger tube according to another embodiment of the present invention.

19B represents an enlarged cross-sectional view of a main portion of the heat exchanger tube shown in FIG. 19A. Referring to FIGS. 19A and 19B, a heat exchanger tube 1 is provided on its outer surface with spiral grooves M1 having a helix angle θ1 in relative to the axis Z of the tube, and with corrugate grooves M2 having a helix angle θ1 in relative to the axis Z of the tube, the helix angle θ1 differing in features from the helix angles θ2.

Namely, in this example shown in FIGS. 19A and 19B, the helix angle θ2 of the corrugate grooves M2 is smaller than the helix angle θ1 of the spiral grooves M1. However, the twisting direction of the helix angle θ2 of the corrugate grooves M2 in relative to the axis Z of the tube is the same as that of helix angle θ1 of the spiral grooves M1. A spiral rib N is formed on the inner surface of the heat exchanger tube 1 in conformity with the corrugate grooves M2, i.e. the location and shape of the spiral rib N coincide with those of the corrugate grooves M2.

The heat exchange performance of each specific examples of the heat exchanger tube 1 of this Example 10 is shown in Table 9 wherein Samples Nos. 57 to 59 represent the heat exchanger tube 1 of this Example 10.

The heat exchanger tube 1 representing these Samples Nos. 57 to 59 can be manufactured as follows.

Figure 20A:
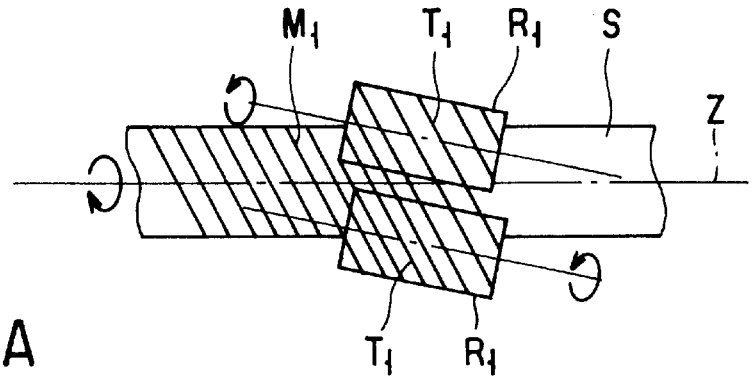
FIGS. 20A and 20B are schematic illustrations showing another example of manufacturing method of a heat exchanger tube of the present invention.
Figure 20B:
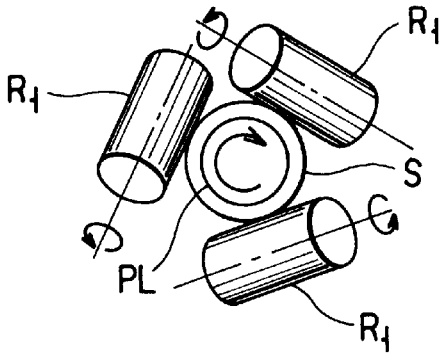

First of all, the spiral grooves M1 are formed. Then, as shown in FIGS. 20A and 20B, plural number of rolls, i.e. three rolls R1 in this example, each provided with ribs T1 of desired shape for forming spiral grooves M1 on the smooth peripheral surface of the raw tube S, are arranged in such a manner that three rolls R1 are disposed slantwise around the same peripheral portion of the raw tube, i.e. at an predetermined angle in relative to the axis Z of the raw tube S. Then, these three rolls R1 are pressed onto the outer surface of the raw tube S from three directions. Concurrently, these rolls R1 are allowed to rotate about their own axes while these rolls are pressed onto the outer surface of the raw tube S, thereby forming the spiral grooves M1 on the outer surface of the raw tube S.

The rotation of the rolls can be effected by driving at least one of the rolls R1. Namely, when one of the rolls R1 is rotated, the raw tube S is caused to move in the working direction of the raw tube S by the driving force of this roll R1. Therefore, if other rolls R1 are simply pressed onto the outer surface of the raw tube S. predetermined kinds of spiral grooves can be formed on the outer surface of the raw tube S by the rotations of aforementioned other rolls R1.

In this case, if this working is performed while inserting a plug PL having a smooth outer surface into the interior of raw tube S, the inner surface of the raw tube S can be kept smooth.

Figure 21:
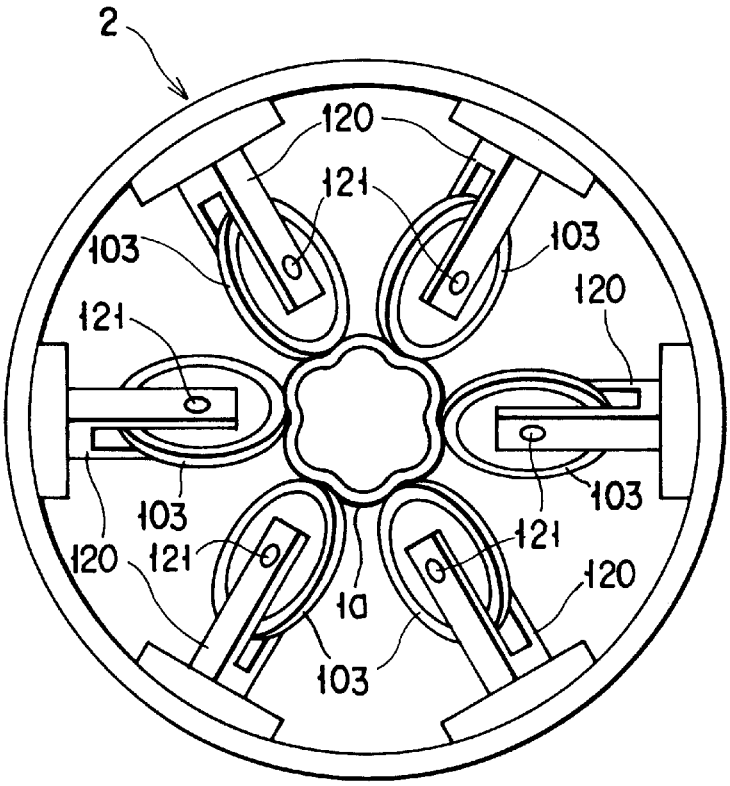
FIG. 21 is a plan view illustrating a main portion of an apparatus for manufacturing a heat exchanger tube according to another embodiment of the present invention.

The corrugate grooves M2 can be formed to the raw tube S1 provided in advance with the aforementioned spiral grooves M1 by making use of a working machine shown in FIG. 21. The working machine shown in FIG. 21 is provided with a cylindrical head 102 in side of which six U-shaped supporting frames 120 are mounted in such a manner that all of these supporting frames 120 are extended to the center of the cylindrical head 102 and equidistantly spaced apart. A disk 103 of the same dimension is rotatably sustained by each supporting frame 120 in such a manner that the plane of the disk 103 is inclined at a predetermined angle to the axis of the head 102. Then, the raw tube S1 provided in advance with the aforementioned spiral grooves M1 is introduced into the central space encircled by these six disks 103, and then drawn toward a predetermined direction. As a result, each disk 103 is caused rotate due to the frictional contact thereof with the outer surface of the raw tube S1, and hence the corrugate grooves M2 are formed on the outer surface of the raw tube S1, thus manufacturing the heat exchanger tube 1.

EXAMPLE 11

Figure 22:
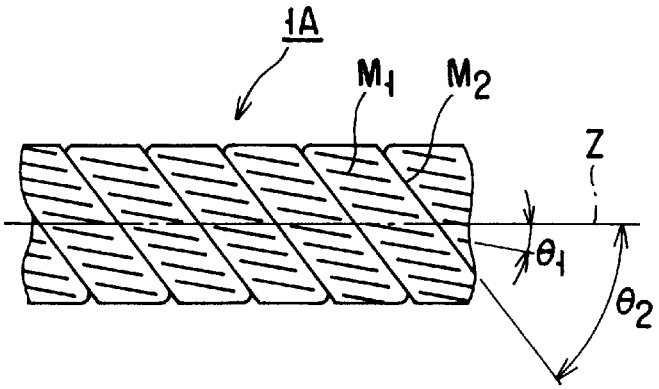
FIG. 22 is a perspective view showing a heat exchanger tube according to another embodiment of the present invention.

FIG. 22 schematically illustrates another example of a heat exchanger tube according this present invention. This heat exchanger tube 1A is featured in that the helix angle θ2 of the corrugate grooves M2 in relative to the axis Z of the tube is made larger than the helix angle θ1 of the spiral grooves M1 and that the twisting direction of the helix angle θ1 of the corrugate grooves M2 in relative to the axis Z of the tube is the same as that of helix angle θ1 of the spiral grooves M1. Other features of the heat exchanger tube 1A are the same as those of Example 10.

Figure 23:
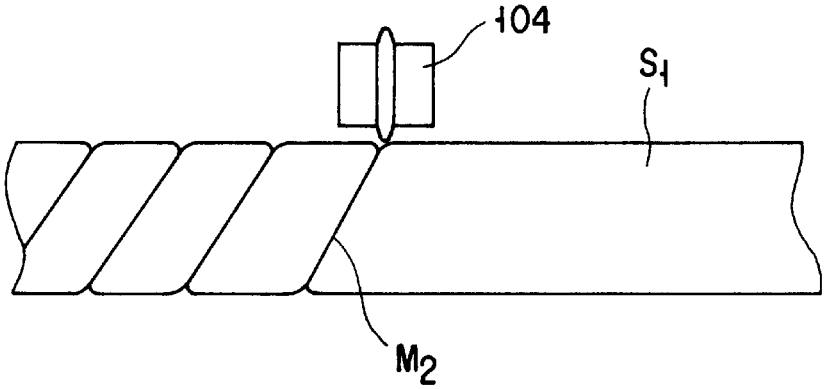
FIG. 23 is a side view illustrating one process in the manufacturing method of a heat exchanger tube according to another embodiment of the present invention.

The heat exchanger tube 1A according to this example may be manufactured in the same manner as in the case of Example 10. However, the corrugate grooves M2 can be formed also by a method shown in FIG. 23. Namely, any required number of rolls 104 are disposed around the raw tube S1 provided in advance with the spiral grooves M1, and then pressed onto the outer surface of the raw tube S1 to form the corrugate grooves M2 on the outer surface of the raw tube S1, thus manufacturing the heat exchanger tube 1A.

The heat exchange performance of each specific examples of the heat exchanger tube 1A of this Example is shown in Table 9 wherein Samples Nos. 54 to 56 represent the heat exchanger tube 1A of this Example.

EXAMPLE 12

Figure 24:
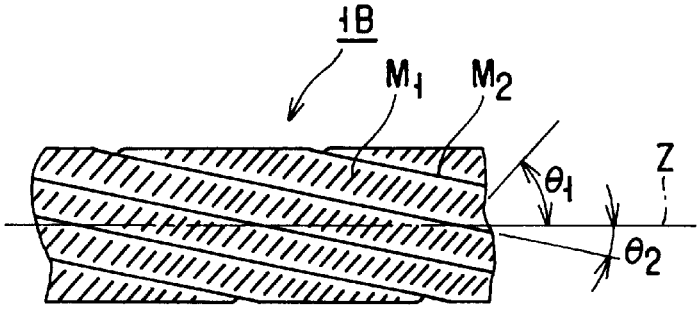
FIG. 24 is a perspective view showing a heat exchanger tube according to another embodiment of the present invention.

FIG. 24 schematically illustrates another example of a heat exchanger tube according this present invention. This heat exchanger tube 1B is featured in that the helix angle θ2 of the corrugate grooves M2 in relative to the axis Z of the tube is made smaller than the helix angle θ1 of the spiral grooves M1 and that the twisting direction of the helix angle θ2 of the corrugate grooves M2 in relative to the axis Z of the tube differs from that of helix angle θ1 of the spiral grooves M1. Other features of the heat exchanger tube 1A are the same as those of Example 10.

The heat exchanger tube 1B according to this example may be manufactured in the same manner as in the case of Example 10. However, the corrugate grooves M2 can be formed also by a method shown in FIG. 23.

The heat exchange performance of one specific example of the heat exchanger tube 1B of this Example is shown in Table 9 wherein Sample No. 60 represents the heat exchanger tube 1B of this Example.

Performance Test

A heat exchange test was performed under the same conditions as mentioned above by making use of a testing apparatus as shown in FIG. 12. The test samples employed in this exchange test were the specific samples of heat exchanger tube which have been prepared in the above Examples; a plain tube which was not provided on its outer surface with grooves; the heat exchanger tube (hereinafter referred to as Conventional Example 1) which has been manufactured according to the method explained in Japanese Utility Model Unexamined Publication S/57-100161 and provided on its outer surface with fine spiral grooves; and a heat exchanger tube provided only with corrugate grooves and not provided with spiral grooves.

Results measured of heat exchange performance

Table 9 describes the results measured of heat exchange performances of each sample tube, i.e. the results being indicated as a comparison in overall heat transfer coefficient between the sample tubes of this invention and the Conventional Example 1, which are measured by setting the flow rate of the absorption liquid layer to 0.02 kg/m-s and the inter-tube flow velocity to 2 m/sec.

Figure 25:
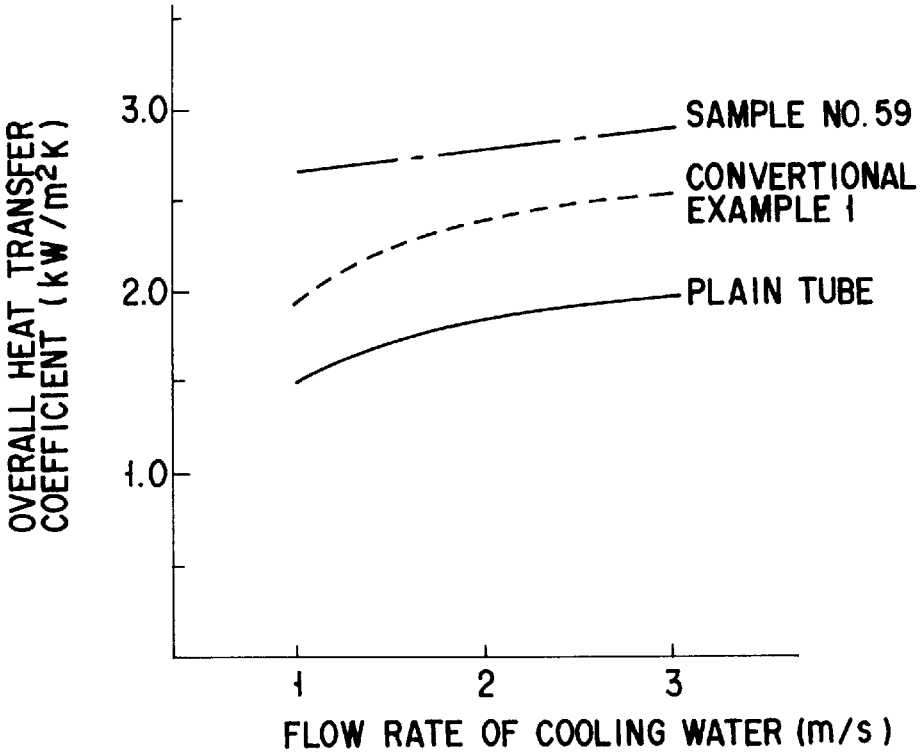
FIG. 25 is a graph illustrating the performance of a heat exchanger tube according to another embodiment of the present invention.

As a typical example indicating most preferable performance among the heat exchanger tubes of this invention, the measured results of the Sample No. 59 on the overall heat transfer coefficient to the cooling water flowing inside the tube are described in FIG. 25.

As shown in the following Table 9 and FIG. 25, the heat exchanger tubes of this invention exhibited far excellent heat exchange properties as compared with the conventional heat exchanger tubes.

TABLE 9

| | Corrugate groove | | | Spiral groove-bearing | | | |
|---|---|---|---|---|---|---|---|
| Sample No. | Number of groove (–) | Groove depth (mm) | Helix angle (°) | Number of groove (–) | Groove depth (mm) | Helix angle (°) | Performance ratio |
| Plain tube | | | | | | | 77 |
| Comparative example (corrugate tube) | 6 | 0.50 | 30 | | | | 95 |
| Conventional example | | | | 71 | 0.30 | 40 | 100 |
| 54 | 3 | 0.50 | 75 | 71 | 0.30 | 40 | 108 |
| 55 | 3 | 0.85 | 75 | 28 | 0.75 | 40 | 105 |
| 56 | 3 | 0.50 | 75 | 89 | 0.30 | 3 | 105 |
| 57 | 6 | 0.50 | 15 | 53 | 0.30 | 60 | 113 |
| 58 | 6 | 0.50 | 30 | 49 | 0.30 | 80 | 113 |
| 59 | 12 | 0.50 | 10 | 53 | 0.30 | 60 | 115 |
| 60 | 6 | 0.50 | 20 | 53 | 0.30 | −60 | 110 |

* The performance ratio represents a ratio in the overall heat transfer coefficient (the inter-tube flow velocity to 2 m/sec.) between the conventional example and other samples by defining the overall heat transfer coefficient of the conventional example as being 100.
The corrugation grooves of Samples No. 1 to No. 3 were formed by the method shown in FIG. 23.
The corrugation grooves of Samples No. 4 to No. 7 and Comparative Example were formed by the method shown in FIG. 21.
Only Sample No. 7 was manufactured such that the twisting direction of the corrugate grooves in relative to the axis of tube was formed opposite to the twisting direction of the spiral grooves.

EXAMPLE 13

Figure 26:
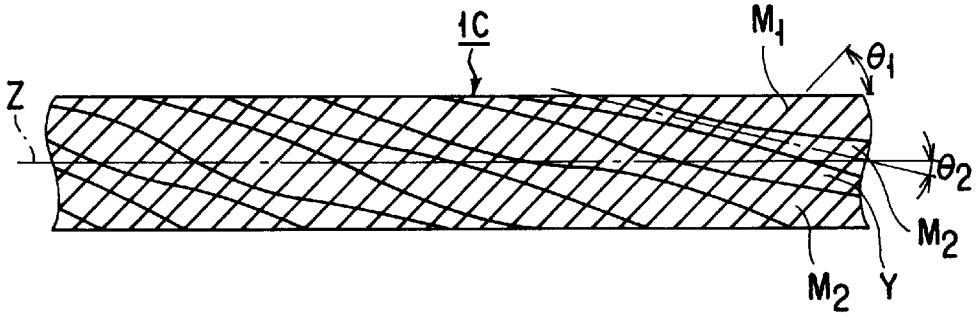
FIG. 26 is a perspective view showing a heat exchanger tube according to another embodiment of the present invention.

FIG. 26 schematically illustrates a modification of a heat exchanger tubes described in Examples 10 to 12. Referring to FIG. 26, the heat exchanger tube 1C is provided on its outer surface with spiral grooves M1 having a helix angle θ1. The reference numeral M2 represents grooves which is different from the spiral grooves M1 and are formed on the outer surface of heat exchanger tube 1C. This grooves M2 have a helix angle θ2 of 35° or less in relative to the axis Z of the tube 1C. A spiral rib is formed on the inner surface of the heat exchanger tube 1C in conformity with the corrugate grooves M2, i.e. the location and shape of the spiral rib coincide with those of the corrugate grooves M2.

Main features of the heat exchanger tube 1C according to this example resides in that the direction of the helix angle θ1 of the spiral grooves M1 formed on the outer surface of the tube 1C is opposite in relative to the axis Z of the tube 1C to the helix angle θ2 of the spiral grooves M2.

The heat exchange performance of this specific example of the heat exchanger tube 1C of this Example is shown in the following Table 10.

The helix angle θ2 of the spiral grooves M2 of this Example in relative to the axis Z is two in kind, i.e. 20° and 35°.

EXAMPLE 14

Figure 27:
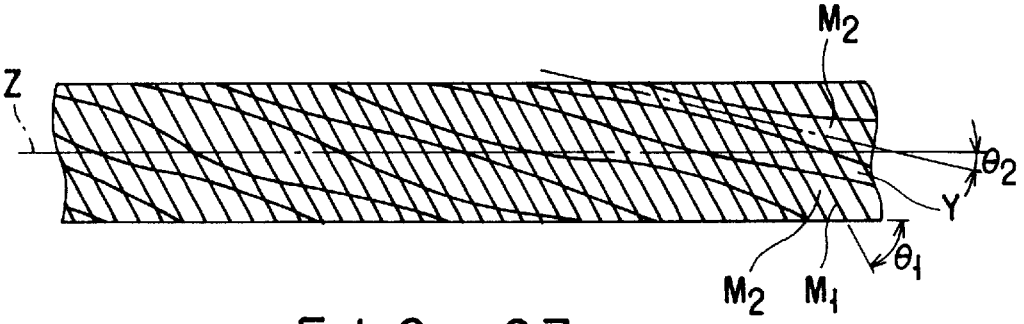
FIG. 27 is a perspective view showing a heat exchanger tube according to another embodiment of the present invention.

FIG. 27 schematically illustrates another modification of a heat exchanger tubes described in Examples 10 to 12.

Main features of the heat exchanger tube according to this example resides in that the direction of the helix angle θ1 of the spiral grooves M1 formed on the outer surface of the tube 1C is the same in relative to the axis Z of the tube 1C with the helix angle θ2 of the spiral grooves M2. Other features of this heat exchanger tube are the same as those of Example 13.

The heat exchange performance of this specific example of the heat exchanger tube of this Example is shown in the following Table 10.

The helix angle θ2 of the spiral grooves M2 of this Example in relative to the axis Z is two in kind, i.e. 12° and 15°.

The heat exchanger tubes according to Examples 13 and 14 can be manufactured as follows.

As shown in FIGS. 9A and 9B, plural sets of rolls, each provided with ribs for forming predetermined kinds of spiral grooves, e.g. in this example, two sets of rolls, each set of rolls being consisted of three rolls R1 or R2 provided respectively with ribs T3 and ribs T4 for forming two kinds of spiral grooves M11 and M12 are separately disposed on the smooth outer surface of a raw tube S in such a manner that three dies in each set of dies are positioned equidistantly and slantwise (at a predetermined angle to the axis Z of the raw tube) along the same peripheral surface portion of the raw tube S.

Then, these two kinds of rolls R1 and R2 are pressed onto the outer surface of the raw tube S from three directions. On the other hand, a plug PL having a smooth outer surface is inserted into the inside of the raw tube S, and these two kinds of rolls R1 and R2 are allowed to rotate about their own axes while these rolls are pressed onto the outer surface of the raw tube S, thereby forming the spiral grooves M11 and M12.

If three or more kinds of spiral grooves are to be formed in this manner, the corresponding number of rolls are disposed at a predetermined interval along the longitudinal direction of the raw tube, and then a heat exchanger tube provided with required number of spiral grooves can be manufactured in a single step as mentioned above.

The grooves M2 can be formed on the outer surface of the raw tube S1 provided in advance with the aforementioned spiral grooves M1 by making use of a working machine shown in FIG. 21. The working roll 103 shown in FIG. 22 can be manufactured as shown in FIG. 28. Namely, an axial bore 132 is formed at the middle of a square metal plate, each corner portion of this metal plate is curvedly chamfered and at the same time both sides of this chamfered portion 130 are cut away, thereby forming the working roll 103 having a plain portion between the chamfered portions 130. Then, the raw tube S1 provided in advance with the aforementioned spiral grooves M1 is introduced into the central space encircled by six disks 103 which are mounted on the working machine shown in FIG. 21, and then drawn toward a predetermined direction. As a result, each disk 103 is caused rotate due to the frictional contact thereof with the outer surface of the raw tube S1, and hence the corrugate grooves M2 are formed on the outer surface of the raw tube S1.

If the raw tube S1 is drawn out while contacting the same portion of each working roll 103 with the outer surface of the raw tube S1, both the groove width W1 and groove depth dA of the grooves M2 will be formed at the same portion, whereas if the raw tube S1 is drawn out while contacting a different portion of each working roll 103 with the outer surface of the raw tube Si, both the groove width W1 and groove depth dA of the grooves M2 will be formed at different portions.

If the grooves M2 are desired to be formed slantwise at a predetermined helix angle θ2 in relative to the axis Z, each working roll 103 is disposed slantwise at a predetermined helix angle θ2 in relative to the axis Z, and then the raw tube S1 is drawn out.

The grooves M2 formed on the heat exchanger tube function as explained below.

Namely, when an absorption liquid is dropped onto the upper surface of the heat exchanger tube, the absorption liquid moves along the grooves M2 and spreads or diffuses from the shallow portion of the groove to the deep portion of the groove (in the direction of the axis Z), and at the same time a turbulence in liquid layer is caused in the direction of the axis Z due to the changes in the bottom width W2 of the grooves. The absorption liquid thus spread in the direction of the axis Z while being disturbed at the interface portion thereof crosses over the ridge portion Y and moves along the periphery of the tube to move into the neighboring grooves M2. When the absorption liquid diffuses along the periphery of the tube and cross over the ridge portion Y, the liquid layer is further disturbed.

On the other hand, at the bottom surface of the heat exchanger tube, the absorption liquid moves from the deep portion of the grooves M2 to the shallow portion of the grooves M2.

If the grooves M2 are formed slantwise at a predetermined helix angle θ2 in relative to the axis Z, the diffusion of the absorption liquid in the longitudinal and circumferential can be further promoted and at the same time the turbulence of absorption liquid can be also promoted.

The aforementioned helix angle θ2 should preferably be not more than 35°. If this helix angle θ2 exceeds over 35°, the diffusion or spreading of the absorption liquid may be obstructed.

The heat exchange performance test of each sample tube obtained according to the above examples was performed under the same conditions using the same testing machine as described above, the results being shown in Table 10. In this Table 10, the heat exchange performance are measured by setting the flow rate of the absorption liquid layer to 0.02 kg/m-s and the inter-tube flow velocity to 2m/sec. Further, the heat exchange performance is indicated by a performance ratio which represents a ratio in the overall heat transfer coefficient between a spiral groove-bearing tube of the Conventional Example 1 and other sample tubes.

As a typical example indicating most preferable performance among the heat exchanger tubes of this invention, the measured results of the Sample No. 63 on the overall heat transfer coefficient to the cooling water flowing inside the tube are described in FIG. 29.

TABLE 10

Shape and heat exchanger performance of samples of heat exchanger tube

| | Groove varying in sectional area | | | | | |
|---|---|---|---|---|---|---|
| Sample No. | Maximum groove depth (mm) | Minimum groove depth (mm) | Maximum bottom width (mm) | Minimum bottom width (mm) | Number of groove (–) | Helix angle (°) |
| Plain tube Conventional example 1*2 | | | | | | |
| Conventional example 2*3 | 1.6 | 0.2 | 4 | 2 | 6 | 15 |
| 61 (Shape of FIG. 26) | 1.6 | 0.2 | 4 | 2 | 6 | 35 |
| 62 (Shape of FIG. 26) | 1.6 | 0.2 | 4 | 2 | 6 | 20 |
| 63 (Shape of FIG. 27) | 1.6 | 0.2 | 4 | 2 | 6 | 12 |
| 64 (Shape of FIG. 27) | 1.6 | 0.2 | 4 | 2 | 6 | 15 |

| | Spiral groove | | | |
|---|---|---|---|---|
| Sample No. | Number of groove (–) | Groove depth (mm) | Helix angle (°) | Performance ratio*1 |

TABLE 10-continued

| Shape and heat exchanger performance of samples of heat exchanger tube | | | | |
|---|---|---|---|---|
| Plain tube | | | | 77 |
| Conventional example 1*2 | 71 | 0.30 | 40 | 100 |
| Conventional example 2*3 | | | | 93 |
| 61 (Shape of FIG. 26) | 29 | 0.50 | −60 | 104 |
| 62 (Shape of FIG. 26) | 51 | 0.10 | −80 | 105 |
| 63 (Shape of FIG. 27) | 49 | 0.30 | 60 | 113 |
| 64 (Shape of FIG. 27) | 17 | 0.30 | 80 | 112 |

*1: The performance ratio represents a ratio in the overall heat transfer coefficient (the inter-tube flow velocity to 2 m/sec.) between the conventional example (a spiral groove-bearing tube) and other samples by defining the overall heat transfer coefficient of the conventional example as being 100.
*2: One example of heat exchanger tube described in Japanese Utility Model Unexamined Publication S/57-100161.
*3: One example of heat exchanger tube described in Japanese Patent Unexamined Publication H/8-94208.
Note:
The pitch of change in cross-sectional area of the groove is about 40 mm in the longitudinal direction.

It will be seen from Table 10 that the heat exchanger tube according to this invention is far superior in heat exchange property as compared with the heat exchanger tube of the Conventional Example, especially when both groove width and depth are moderately changed along the axial direction of the tube and when the helix angle to the axial direction of the tube is set to not more than 35°.

It will be seen from Table 10 that Sample Nos. 62 to 64, where the helix angle of the grooves is confined to the range of 5° to 20°, and at the same time the groove depth of the spiral grooves is confined to 0.1 to 0.8 mm and the helix angle of the spiral grooves is confined to 30° to 80°, exhibited an improvement in heat exchange property by 25% or more as compared with the heat exchanger tube of Conventional Example 1.

Further, it will be seen from Table 10 that Sample Nos. 63 and 64, where spiral grooves are formed on the outer surface of the tube, and where the twisting direction of the spiral grooves is the same (in relative to the axis of tube) with the twisting direction of the grooves indicating a moderate change in both width and depth, exhibited an improvement in heat exchange property by 10% or more as compared with the heat exchanger tube of Conventional Example 1.

The heat exchanger tubes according to Examples 13 and 14 are also useful as a heat exchanger tube of these evaporator and dropping liquid film type regenerator.

Since the heat exchanger tubes according to Examples 13 and 14 are featured in that both groove width and depth are moderately changed along the axial direction of the tube, and the helix angle to the axial direction of the tube is set to not more than 35°, they are effective in uniformly spreading a cooling medium in longitudinal direction of the tube. Furthermore, since the spiral grooves are formed on the outer surface of the tube, the surface area of the outer surface of the tube can be markedly increased. Moreover, since ribs are formed also on the inner surface of the tube, the heat exchange performance inside the tube can be also improved, resulting in a high heat exchange performance of the heat exchanger tube.

According to the heat exchanger tubes of Examples 13 and 14, since two kinds of grooves are formed on the outer surface of the tube, the following effects would be obtained.

The corrugate grooves which are formed in a manner to produce corresponding ribs on the inner surface of the tube are effective in sufficiently spreading an absorption liquid over the outer surface of the heat exchanger tube, and at the same time to sufficiently promote a turbulence in the absorption liquid layer in the dropping direction of the absorption liquid (a direction perpendicular to the longitudinal direction of the heat exchanger tube) as well as in the longitudinal direction of the tube. On the other hand, the spiral grooves are also effective in promoting a turbulence in the absorption liquid layer.

When the heat exchanger tube of this invention is mounted on an absorber where heat exchanger tubes are to be horizontally arranged, a turbulence is caused to generate at the intersection between the corrugate grooves and the spiral grooves. Furthermore, a difference in thickness of the absorption liquid layer is caused to generate at the intersection between the corrugate grooves and the spiral grooves on the outer surface of the tube, and hence the Marangoni convection can be further promoted. Moreover, since ribs are formed on the inner surface of the tube due to the corrugate grooves, a turbulence is caused to generate also in the cooling water. As a result, the inside heat transfer coefficient can be improved and hence the heat exchange can be further improved.

If the helix angle of the corrugate grooves is set smaller than the helix angle of the spiral grooves, the absorption liquid can be effectively spread along the deep corrugate grooves and in the longitudinal direction of the tube, thus making it possible to promote the heat exchange performance. Further, if the twisting direction of both corrugate grooves and the spiral grooves are set to the same in relative to the axis of the tube, the absorption liquid can be stably spread in the longitudinal direction of the tube, thus making it possible to promote the heat exchange performance.

EXAMPLE 15

Figure 30:
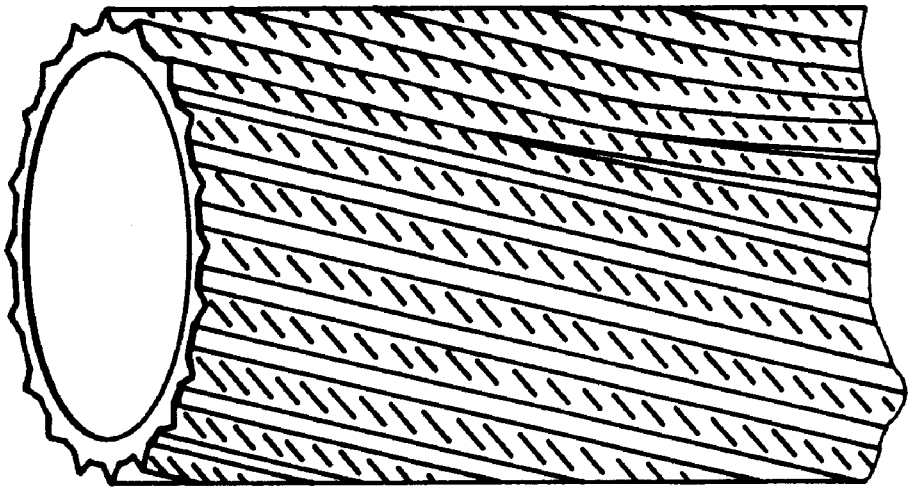
FIG. 30 is a perspective view showing a heat exchanger tube according to another embodiment of the present invention.
Figure 31:
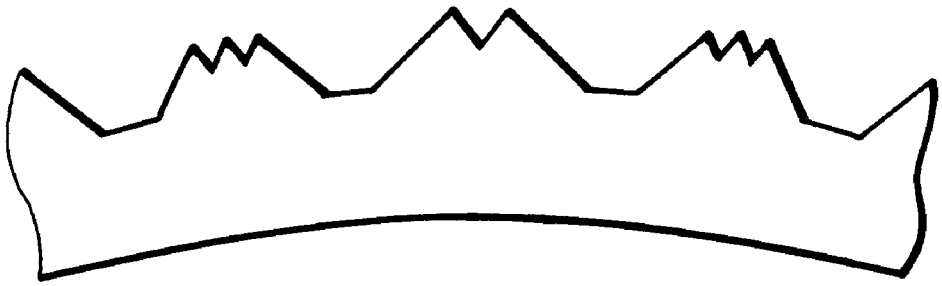
FIG. 31 is an enlarged sectioned view illustrating a main portion of a heat exchanger tube according to another embodiment of the present invention.

FIG. 30 schematically illustrates a perspective view of a modification of a heat exchanger tubes according to a modified example of this invention. Referring to FIG. 30, the heat exchanger tube is provided on its outer surface with groove portions and ridge portions which are alternately formed. FIG. 31 is an enlarged cross-sectional view of the heat exchanger tube shown in FIG. 30. In this heat exchanger tube, one kind of the grooves is trapezoidal cross-section, and the bottom thereof (circular or linear) has a length of 0.1 to 1.0 mm.

Specifically, the raw tube thereof is constructed such that the outer diameter is 19.05 mm, the wall thickness thereof is 0.85 mm, the helix angle of the first grooves in relative to the axis of tube is 15° in right hand direction, the groove depth of the first grooves is 0.7 mm, the bottom width of the first grooves is 0.7 mm, the pitch in the circumferential of the first grooves is 1.81 mm, the number of the first grooves is 33, the helix angle of the second grooves in relative to the axis of tube is 60° in right hand direction, the groove depth of the second grooves is 0.3 mm, the bottom width of the second grooves is 0.0 mm, the pitch in the circumferential of the second grooves is 0.84 mm, and the number of the second grooves is 71.

A heat exchange test of these heat exchanger tubes was performed under the same conditions as mentioned above by making use of a testing apparatus as shown in FIG. 12. The results are shown in the following Table 11.

As the conventional examples No.1 and No.2, a heat exchanger tube which is described in Japanese Utility Model Unexamined Publication S/57-100161 was also prepared and evaluated.

TABLE 11

| | First grooves | | | | | Second grooves | | | | |
|---|---|---|---|---|---|---|---|---|---|---|
| Sample No. | Number of groove | Groove depth (mm) | Pitch (mm) | Groove bottom (mm) | Helix angle (°) | Number of groove | Groove depth (mm) | Pitch (mm) | Groove bottom (mm) | Helix angle (°) |
| Conventional example 1 | 31 | 0.70 | 1.93 | 0.00 | 30 | — | — | — | — | — |
| Conventional example 2 | 71 | 0.30 | 0.84 | 0.00 | 40 | — | — | — | — | — |
| 65 | 33 | 0.70 | 1.81 | 0.70 | 15 | 71 | 0.30 | 0.84 | 0.00 | 60 |
| 66 | 33 | 0.70 | 1.81 | 0.70 | 20 | 71 | 0.30 | 0.84 | 0.20 | 60 |
| 67 | 33 | 0.70 | 1.81 | 0.00 | 20 | 57 | 0.40 | 1.05 | 0.25 | 40 |
| 68 | 30 | 0.70 | 1.99 | 0.43 | 30 | 71 | 0.30 | 0.84 | 0.20 | −40 |

| Sample No. | Thickness of raw tube (mm) | Overall heat transfer coefficient in comparison with that of conventional tube |
|---|---|---|
| Conventional example 1 | $t_{0.85}$ | 100 |
| Conventional example 2 | $t_{0.65}$ | 100 |
| 65 | $t_{0.85}$ | 118 |
| 66 | $t_{0.85}$ | 122 |
| 67 | $t_{0.85}$ | 117 |
| 68 | $t_{0.85}$ | 117 |

The minus sign in the helix angle indicates a left-handed helix.

It will be seen from above Table 11 that since at least two kinds of grooves were employed in Sample Nos. 65 to 68, an improved performance was admitted in these samples. Specifically, these samples all indicated 17% or more of improvement in overall heat transfer coefficient. This improvement can be ascribed to the phenomenon that the absorption liquid flowing on the outer surface of the tube is caused to be separated two directions and then collided with each other at the intersection thereof, thus promoting the turbulence in the absorption liquid layer.

The sectional shape of these grooves may be optionally varied as long as the sectional shape meets the aforementioned conditions, i.e. it may be elongated in the longitudinal direction of the tube.

The above explanations regarding Examples 10 to 15 are centered on one example where the heat exchanger tube according to this invention is employed in an absorber of the absorption refrigerator. Meanwhile, in the case of an evaporator or dropping liquid film type regenerator of absorption refrigerator, a group of heat exchanger tubes are mounted horizontally as in the case of the absorber, and a liquid is gravitationally dropped or sprayed from the top onto the outer surfaces of the heat exchanger tubes one after another.

Therefore, when the heat exchanger tube of this invention is mounted on an evaporator or on a dropping liquid film type regenerator, the spreading or turbulence of a refrigerant or solution in these evaporator and dropping liquid film type regenerator can be also effected as in the case of the aforementioned absorber. Namely, the heat exchanger tubes according to Examples 10 to 15 are also useful as a high performance heat exchanger tube of these evaporator and dropping liquid film type regenerator.

Additional advantages and modifications will readily occur to those skilled in the art. Therefore, the invention in its broader aspects is not limited to the specific details, and representative embodiments shown and described herein. Accordingly, various modifications may be made without departing from the spirit or scope of the general inventive concept as defined by the appended claims and their equivalents.

We claim:

1. A heat exchanger tube adapted for use with at least one device selected from the group consisting of an absorber, a regenerator and an evaporator of an absorption refrigerator, said heat exchanger tube effecting a heat exchange between a fluid inside the heat exchanger tube and a liquid flowing outside the heat exchanger tube, and said heat exchanger tube comprising:

a first kind of spiral grooves; and a second kind of spiral grooves, wherein each of said first and second kinds of spiral grooves are formed on an outer surface of the heat exchanger tube, wherein a twisting direction of said first kind of spiral grooves relative to an axis of said heat exchanger tube is the same as a twisting direction of said second kind of spiral grooves, wherein a helix angle of said first kind of spiral grooves is larger than a helix angle of said second kind of spiral grooves, said helix angle of said first kind of spiral grooves falling within a range of 3° to 80° relative to the axis of said heat exchanger tube and said helix angle of said second kind of spiral grooves falling within a range of 3° to 30° relative to the axis of said heat exchanger tube, and wherein a groove depth of said first kind of spiral grooves is smaller than a groove death of said second kind of spiral grooves, said groove depth of said first kind of spiral grooves falling within a range of 0.1 to 0.5 mm and said groove depth of said second kind of spiral grooves falling within a range of 0.3 to 0.85 mm.

2. The heat exchanger tube according to claim 1, further comprising a spiral rib formed on an inner surface of said heat exchanger tube in conformity with a shape of the second kind of spiral grooves.

3. The heat exchanger tube according to claim 1, wherein at least one of said first and second kinds of spiral grooves has a trapezoidal cross-sectional shape.

* * * * *